US006332679B1

(12) United States Patent
Higuma et al.

(10) Patent No.: US 6,332,679 B1
(45) Date of Patent: Dec. 25, 2001

(54) IMAGE FORMING METHOD AND IMAGE FORMING APPARATUS

(75) Inventors: Masahiko Higuma, Tohgane; Nobuhiko Takekoshi, Kawasaki; Hajime Kaneko, Kodaira; Sadayuki Sugama, Tsukuba, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/219,598

(22) Filed: Dec. 23, 1998

(30) Foreign Application Priority Data

Dec. 26, 1997 (JP) ..... 9-359810
Feb. 13, 1998 (JP) ..... 10-031224
Dec. 21, 1998 (JP) ..... 10-362760

(51) Int. Cl.[7] ..... B41J 2/01
(52) U.S. Cl. ..... 347/102
(58) Field of Search ..... 347/102, 105, 347/9, 101; 400/611, 120.18; 101/487

(56) References Cited

U.S. PATENT DOCUMENTS 4,242,271 12/1980 Weber et al. .
4,971,408 * 11/1990 Hoisington et al. ..... 347/102
5,041,846 * 8/1991 Vincent et al. ..... 347/102
5,606,356 * 2/1997 Noguchi et al. ..... 347/102
5,784,090 * 7/1998 Selensky et al. ..... 347/102
5,882,388 * 3/1999 Adair et al. ..... 347/105
5,997,136 * 12/1999 Fujisawa et al. ..... 347/102
6,099,102 * 8/2000 Tanaka et al. ..... 347/9
6,120,199 * 9/2000 Takekoshi ..... 400/611
6,142,619 * 11/2000 Miura et al. ..... 347/102

FOREIGN PATENT DOCUMENTS 0 805 049 11/1997 (EP) .
1-85767 3/1989 (JP) .
4-21446 1/1992 (JP) .
10-16382 1/1998 (JP) .
1-85768 3/1999 (JP) .

* cited by examiner

*Primary Examiner*—Eugene Eickholt
(74) *Attorney, Agent, or Firm*—Fitzpatrick, Cella, Harper & Scinto

(57) ABSTRACT

The present invention relates to an image forming method comprising the steps of forming visible images in application of an ink, which at least includes an ink solvent and a color material, onto a recording medium having a porous layer on a surface of the medium from a side of the porous layer; conveying the recording medium from a location for forming images to a location for a subsequent process; and flattening the surface of the recording medium formed with visible images by pressing the surface while heating to form a flattened layer. In a nip region that the surface of the recording medium formed with visible images is pressed, a point A at which the ink solvent contained in the recording medium reaches the boiling point is located upstream of a point B at which the porous layer of the recording medium loses its liquid permeation property.

40 Claims, 11 Drawing Sheets

IMAGE FORMING METHOD AND IMAGE FORMING APPARATUS

BACKGROUND OF THE INVENTION

1. Field of the Invention

This invention relates to an image forming method and an image forming apparatus for forming images using a recording section for recording visible images and a nip region for effecting a flattening process after the visible images are formed.

2. Description of Related Art

A majority of known image forming methods form images by forming visual images using color materials such as dyes and pigments on a recording medium. Such methods, however, raise problems when the recording medium is to be preserved, in that the color materials may be discolored or faded due to operation of ozone or light or that bleeding or the like may occur due to contact with water. There is also a problem that glossing property of the visible image cannot be obtained adequately because the color materials form the surface layer. To treat with this problem, a method for flattening a sheet after recording is effective. Japanese Unexamined Patent Publication No. 4-21446 discloses an image forming apparatus of this kind. FIG. 4 shows a schematic structure of such an apparatus. In FIG. 4, numeral 1 is a fan for blowing warm air; numeral 2 is a heater for warm air; numeral 3 is a belt drive roller; numeral 4 is a fixing belt; numeral 5 is a press roller; numeral 6 is a separation roller; numeral 7 is a heater for pre-drying; numeral 8 is a heat-resistance film; numeral 9 is a fixing heater; numeral 10 is a cooling fan; numeral 11 is a roller; and numeral 13 is a conveyance roller. A recording medium is guided by the heater for pre-drying, and after melting by means of the press roller 5 and the fixing heater 9 with pressure and heat while sandwiched by the fixing belt 4 and the heat-resistance film 8, the recording medium is cooled down to obtain a stable transparent flattened layer.

Such a conventional apparatus has an advantage in that the transparent flattened layer can be obtained stably. The apparatus, however, raises problems where the recording medium with a flattening layer and an ink reception layer is processed with heat and pressure as a flattening process right after the inks create visual images, such that image density is lowered, that the flattening layer is deformed, and that peeling or swelling or cracking of films may occur, since the ink solvent remains in the flattening layer or between the flattening layer and the ink reception layer. Other approaches to cope with such a problem were mainly to arrange multiple dryers and a laminating means for processing the recording medium after images are formed thereon using color materials such as dyes and pigments in a manner as described in the above conventional art or to place a considerable length for conveyance before the recording medium enters such a laminating means. Such an apparatus, however, raises problems such as its structure becomes complicated, manufacturing costs are increased, and the size of the apparatus is enlarged. In any event, the main object of the invention is to process good images with high speed and to eliminate partial image defects that occur when the medium formed with images using inks including color materials and an ink solvent on a porous layer is heated and pressed, or namely, to eliminate partial "peeling" in the multilayer structure occurring due to the gaseous solvent.

SUMMARY OF THE INVENTION

It is an object of the invention to provide an image forming method for realizing formation of a good flattened layer by means of a relatively simplified structure. It is another object of the invention to provide a method for solving the above problem and thereby to accomplish high speed, high quality image formation in a heating and pressing process.

A method and apparatus for forming images according to the invention can solve the above problems, where the image forming apparatus has an ink jet recording section for forming visible images on a recording medium that has on a surface thereof a porous layer having thermoplastic resin particles and a nip region using a thermal pressing member for pressing and heating a recording medium surface on which the visible images are formed. The recording medium is conveyed, with a prescribed conveyance speed, to the nip region while drying, right before the recording medium reaches the nip region, solvent components of inks for forming visual images.

With such an image forming apparatus forming images by means of the thermal pressing member having the nip portion according to the inventions, high quality images can be formed because the ink solvent in the recording medium is dried and evaporated before the recording medium reaches the thermal pressing member, wherein a point that water contained in the recording medium reaches the boiling point is set as point A, a point that the porous layer of the recording medium loses its liquid permeation property is set as point B in the nip region that the recording medium formed with visual images is pressed, and the point A is located upstream of the point B. According to the invention, the apparatus can also be structured in a relatively simple form, so that the cost and size of the apparatus can be reduced.

Particularly, where the recording medium includes an ink reception layer and a porous layer having thermoplastic resin particles formed on the ink reception layer, the porous layer can be flattened to form a protection layer for the ink reception layer after the ink solvent is evaporated so as to eliminate the "peeling" occurring as mentioned before, while the color materials of the inks are held in the ink reception layer.

Where the recording medium includes at least a base material, a separation layer formed on the base material, and a transfer layer formed of a porous layer having thermoplastic resin particles formed on the separation layer, the transfer layer can be flattened to form a color retaining layer after the ink solvent is evaporated so as to eliminate the "peeling" occurring while the color materials of the inks are held in the transfer layer.

DETAILED DESCRIPTION OF THE PREFERRED EMBODIMENTS

Figure 1:
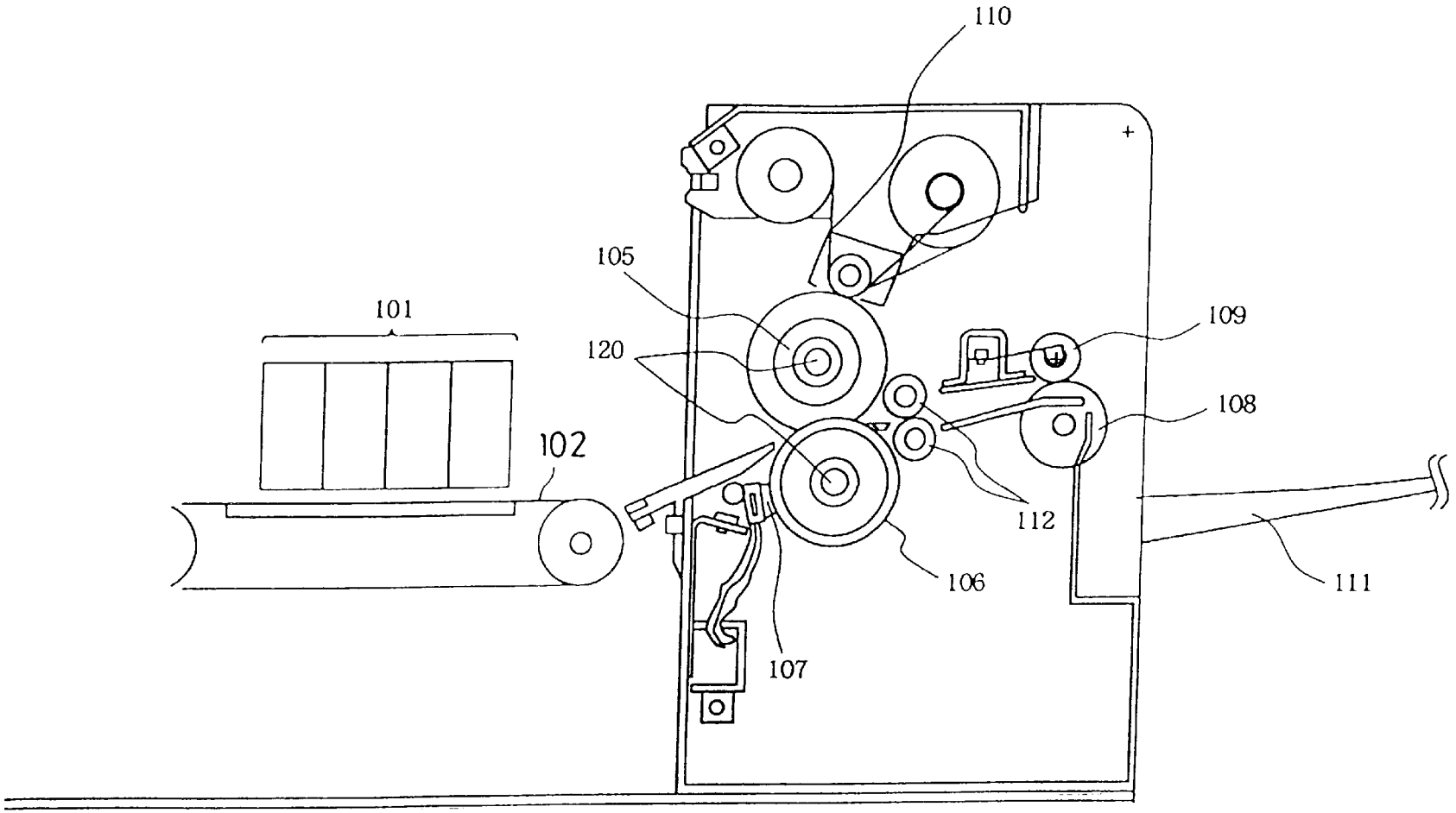
FIG. 1 is an illustration showing an image forming apparatus of a first example according to a first embodiment of the invention.

A flattening process according to the invention can be performed by, e.g., a method in which a film shaped lamination material and a recording medium are melted by application of heat and pressure while the lamination material is overlapped on a recording portion of the recording medium to form a porous layer having thermoplastic resin particles, a method for forming a flattened layer on a recording surface upon applying heat and pressure after recording is made on a top side of the porous layer which has thermoplastic resin particles to permeate inks to the recording surface where the porous layer having such thermoplastic resin particles is formed in advance on the recording layer of a recording medium, and so on.

The recording medium is, herein, defined broadly as including a medium retaining ink or inks discharged from a recording means such as an inkjet recording head or the like. In a first embodiment, the recording medium is made of an ink reception layer and a porous layer, and the ink reception layer retains color materials of the inks. In a second embodiment, a transfer medium corresponds to the recording medium, and the transfer layer made of the porous layer serves as an ink reception layer and retains the color materials of the inks.

Since this embodiment uses such a flattening method thus described, the recording medium has the following constitution. That is, the recording medium according to the invention has a porous layer having thermoplastic resin particles on a surface and preferably includes a base material, a recording layer substantially absorbing and capturing inks and color materials formed on the base material, and a porous layer having a thermoplastic resin layer formed on the recording layer.

The porous layer having thermoplastic resin particles can directly accept the inks, has a permeation property, and substantially does not retain much of the inks and color materials.

If a flattening process does not remove all ink solvent in the flattened layer, the recording medium having the ink reception layer on the base material and the flattened layer on the top surface may raise the problems as described above. To solve such problems, various ways have been so far proposed for making the ink reception layer absorb the entire inks. First, an ordinary image processing method is to limit a discharging amount as much as possible. This method, however, limits color reproduction range and gray scale reproducability. Meanwhile, a method employing multiple densities of the same color is widely used for improvements of gray scale reproducability. This method using such multiple ink densities, however, induces a disadvantageous effect for the image processing in which the discharging amount is limited as described above. That is, reproduction of a highlight portion needs more discharging amount of low-density inks than previously used.

The next problem is to improve absorbing materials that can absorb all inks at the ink reception layer. Aquafic resins based on polyvinylalcohol, inorganic pigments using alumina or the like, and mixtures of those were used previously for absorbing materials, but no absorbing material had absorbing capacity and speed such that inks in a large amount having reached the lower layer could be absorbed immediately where the flattened surface was located as the topmost layer as described above. Widely proposed methods to solve such problems included promoting drying of the ink solvent after images were formed but before the recording medium was flattened by a pre-drying means for heating the medium at a temperature equal to or less than the temperature for flattening. This method, however, required not only multiple heating means but also to be made in a larger size (particularly, in consideration of heat isolation from an inkjet recording head during heating in a case of the inkjet method).

Figure 6:
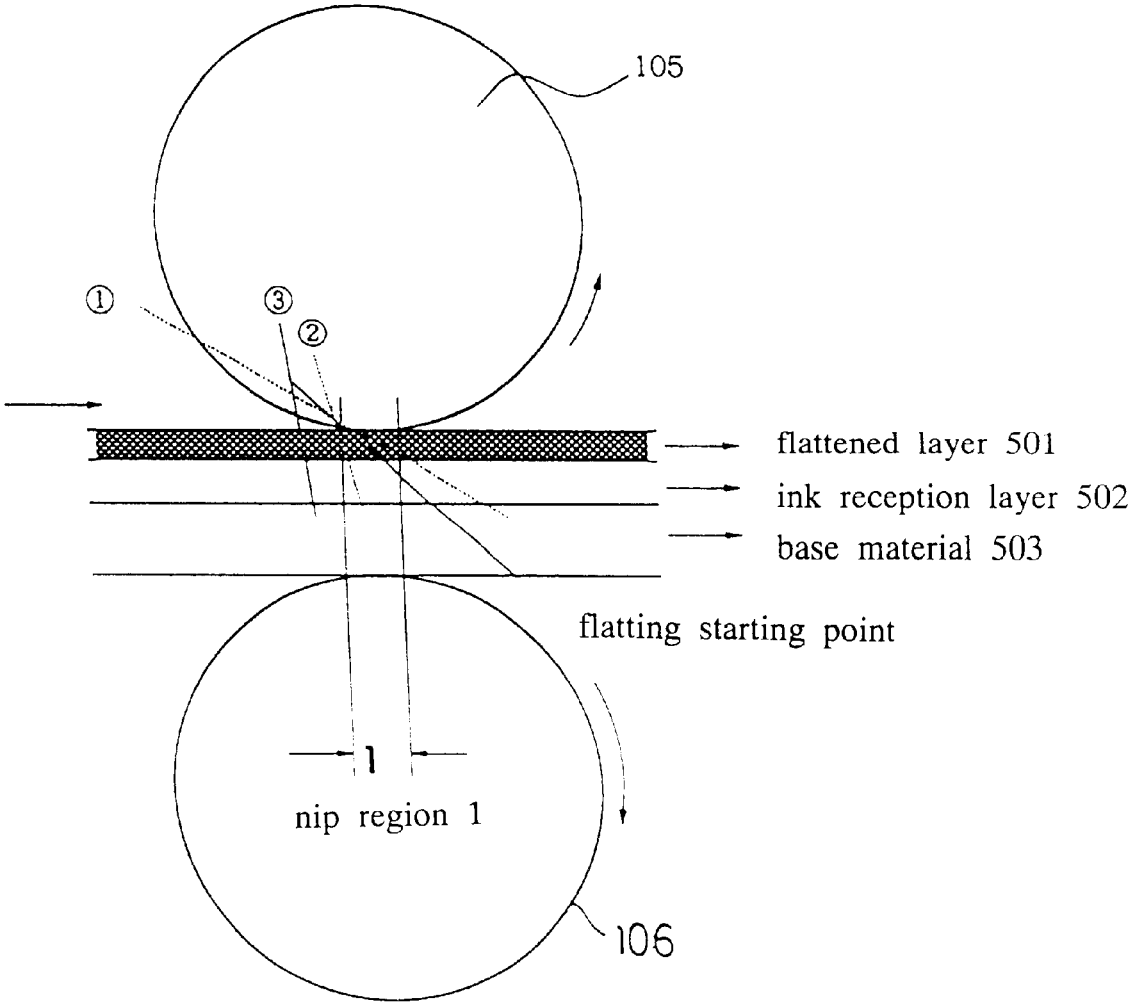
FIG. 6 is an illustration showing a flattening process in the first embodiment of the invention.

With this viewpoint, this invention includes the feature that the ink solvent heated right before the nip region and increase of the temperature of the flattened layer satisfy the following relation. First, the ink includes a coloring component such as dyes and pigments, and a solvent component for solving or dispersing the coloring component. The solvent component is further divided into a component to be dried by evaporation, and a portion to be absorbed in the ink reception layer in the same way as the coloring component. The ink solvent described in this invention indicates a component to be evaporated and dried. It is desirable for the ink solvent to have a lower boiling temperature than the heating temperature to be well evaporated during the flattening process, otherwise the ink solvent is hardly evaporated. The temperature TF during the flattening process satisfies TF>T1 in relation to the boiling temperature T1 for contributing to evaporation and drying of the ink solvent. Similarly, where T2 denotes the melting temperature of the surface layer contributing to lamination, it is general to set TF>T2 in estimation of temperature profile and latitude during the flattening process. That is, materials for the flattened layer are in direct contact with roller or rollers during the flattening process, and the softened porous materials melt, thereby actually increasing the temperature of the surface layer. Consequently, temperature T3 erasing the porous property satisfies TF≡T3>T2. The relation between T1 and T2 is determined by respective bases when compared by their absolute values. For example, if the ink solvent is 100% water, T1 is 100° C., and if the flattened layer material is a latex (based on vinylchloride-vinyl acetic acid), T2 is about 95° C., so that T1>T2. FIG. 6 indicates its outline. A recording medium flattened by a heating roller 105 has an ink reception layer 502 on a base material 503, and a flattened layer 501 and is subject to flattening process at a nip region 1. FIG. 6 illustrates as the flattening layer 501 is to be laminated from the topmost layer from the nip beginning point at that time. The dotted lines of circled 1 to 3 indicate boundaries in the thickness direction of the recording medium between areas where the ink solvent remains as liquid and areas where the ink solvent is vaporized and removed under respective heating conditions per time unit to each of the layers different from each other. If the ink solvent evaporates as shown by a dotted line of circled 1 in FIG. 6, the inks begin to be dried after the flattened layer is formed. However, since the flattening process is done with adequate thermal conductance if the conveyance speed v is low, the inclination of the line becomes steeper as shown by a dotted line circled 2, so that the ink solvent is evaporated and dried before the flattened layer is completely formed (at that time, the more sprayed inks, the lower the inclination of the line of thermal conductance). If the conveyance speed v becomes lower, the surface layer reaches the melting temperature after the ink medium is evaporated and dried before being nipped, so that an ideal state of the flattened layer can be formed where a flattened layer is formed with pressure while being softened.

It is to be noted that the heating method of the invention can use an apparatus with or without a lower roller because the heat is conducted in maintaining the above relation even where the medium is heated from the lower roller in FIG. 6.

When the speed is too low, the flattened layer can be formed only with the heating temperature before reaching the nip region (though it may not work adequately as a printer). However, where the press roller is used, the temperature TF is not necessarily to be raised while not in contact with the roller until the lamination is made, and the speed is generally made higher.

This invention solves those problems and creates good images with lamination by using a relatively simple structure.

Figure 7:
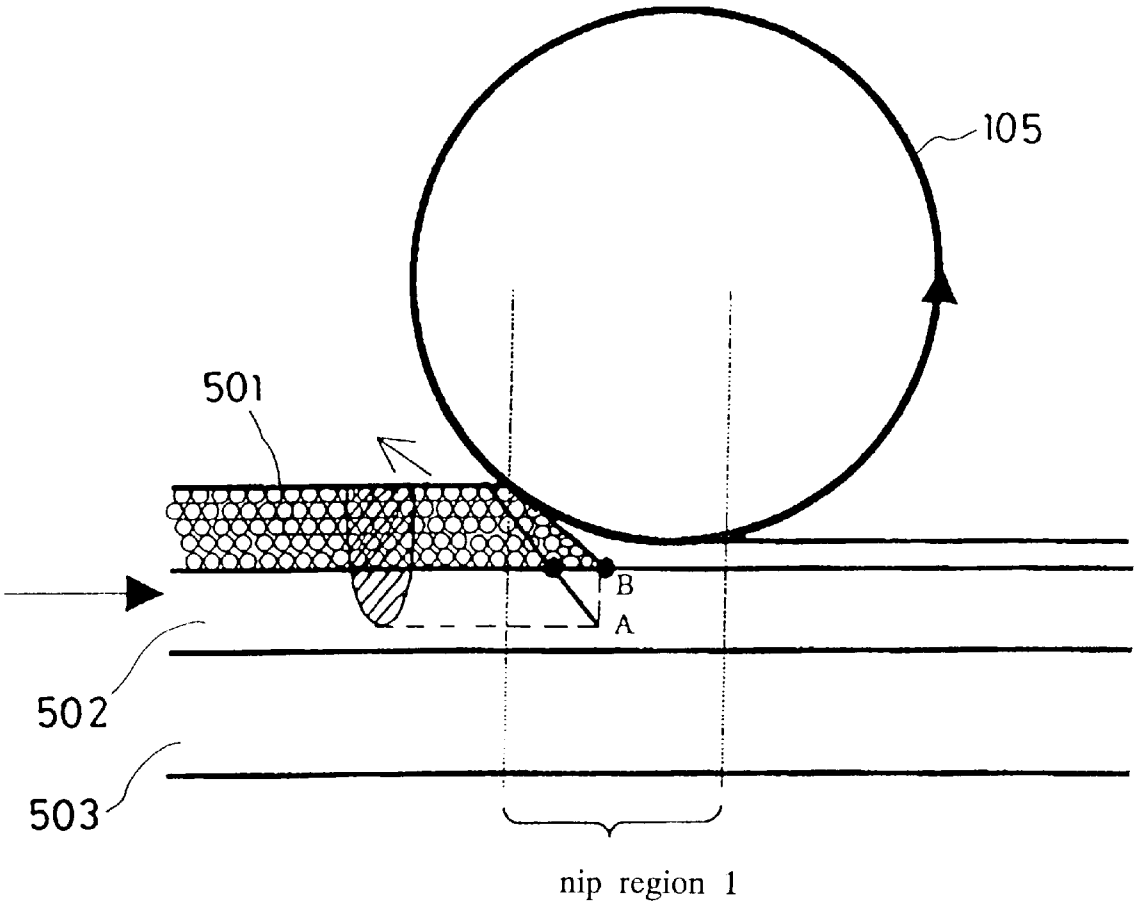
FIG. 7 is an enlarged illustration showing the flattening process in the first embodiment of the invention.

As shown in FIG. 7, applied inks are assumed to exist in the medium. A point where moisture in the inks reaches its boiling point is indicated by A. Meanwhile, a point where the porous layer loses its liquid permeation nature upon flattening is indicated by B. As shown in FIG. 7, the flattening process of the invention is done well as long as A is located upstream of B in the conveyance direction.

It is to be noted that the inkjet method is the most favorable for application of inks into the porous layer in order to obtain high definition color images, but when rough images are used, for example, spraying of inks or the like can be used.

As another method for removing the ink solvent without absorbing the inks at the ink reception layer, it is conceivable that the solvent is designed to be evaporated not only from the porous layer having thermoplastic resin particles but also from the back side, or the base material side, using a base material of a porous material, a base material made of fibers having high steam permeation, or a base material having a structure capable of actively permeating the solvent. In such a case, either or both of the solvent amounts evaporated from the side of the porous layer having the thermoplastic resin particles and from the side of the base material are controllable by selecting or controlling easiness of passing solvent molecules by means of changing, in addition to the thickness of the base material, e.g., the empty hole rate of the porous base material, the profile of empty hole diameter, the size degree of the base material made of fibers, and the hole diameter of the base material having a structure allowing the solvent to pass actively.

First Example of the First Embodiment

The nip region in the invention serves to form the flattened layer by heating and pressing the recording medium. The nip region includes a thermal pressing member in contact with the surface on which visible images are formed. An elastic roller pair mainly made of a rubber is frequently used for constitution of the thermal pressing member. This invention, however, is not limited to this constitution, and the thermal pressing member can be structured to have a nip region for pressing the recording medium and applying heat at the nip region, such as a belt shaped pair or a combination of a belt and a roller.

For the thermal pressing member of the invention, it is general for a roller shaped member that a roller whose inside layer is made of a rubber or a porous material and whose surface layer is made of a resin, as well as a roller made of a rubber or resin, such as a silicon rubber, is to be used. The thermal pressing member is desirably made in selecting a flattened layer material and a good material for separation of layers. A material having good separation nature for all other materials hardly exists in a practical sense. This method, therefore, may use a silicon oil as a releasing aid.

In this invention, a proposed combination is to use a silicon rubber for the thermal pressing member and a latex material for the flattened layer of the recording medium.

In such a combination, if the silicon rubber is an addition type silicon rubber in which polyorganosiloxane in a form of a resin and inorganic fine powders of 0.1 to 10 by weight % are mixed, the combination can improve physical strength and stability for separation. Moreover, if the mean particle size is in a range of 0.2 to 0.8 micron, if the profile width of the particle size is within 3 sigma, and if particles having the size of 0.10 microns or less are 10% or less, the latex layer can permeate the ink solvent faster, thereby reducing direct contact of unabsorbed inks with the thermal heating member as much as possible during the ink recording, and thereby preventing the medium from losing separation nature to the thermal pressing member otherwise caused by ink burning or the like.

To improve separation nature or releasing nature, a method in which a mold releasing agent such as silicon oil is added or soaked during the rubber manufacturing process for, e.g., silicon rubber, has been proposed. However, with this method and no more, the member may not be free from strength deterioration and impaired separation nature due to repeating of heating cycles in repetitive processing of the flattening even where a material having good separation property or a combination of materials having good affinity to each other is used. In association with this, inks, paper powder, dusts, coating agents used for lamination, and parts of those may be attached in a layer form on the surface layer of the thermal pressing member, and the separation nature may be deteriorated. Accordingly, it is favorable to use a cleaning means for cleaning the surface of the thermal pressing member and a means for improving the separation nature between the thermal pressing member and the flattened layer by using a separation aid agent. As such a cleaning means, a means can be used in which a cleaning member made of, e.g.. a non-woven fabric, is disposed in contact with the thermal pressing member to remove dusts and the like clinging in a layer form. When the separation aid agent is used, it is favorable to adjust the application amount to the recording medium at a fixed value or less. If the application amount is too large, the separation aid enters into scratches in the lamination material, thereby readily raising a problem that the scratches become noticeable. To prevent such a problem from occurring while maintaining good separation nature, the oil application amount, in a case of silicon oil, is preferably 20 $g/m^2$ or less, and more preferably, 1 to 5 $g/m^2$ or less.

The invented image formation method can apply inks utilizing a liquid ejection recording method. The liquid ejection recording method is preferably an inkjet method for the purpose of high speed image formation. Some separation aid is applicable to the lamination material of the recording medium before the thermal pressing member effects thermal pressing.

Hereinafter, referring to the drawings, this invention is further described in detail. FIG. 1 is an example of an image forming apparatus according to the invention. This image forming apparatus is formed with a recording head of a liquid ejection recording method (inkjet method) forming images by ejecting liquids having different colors from orifices (not shown) at a recording section 101.

This inkjet type recording head records by ejecting inks onto the recording medium from the ink orifices, and the head advantageously makes the recording means compact, allows printing high definition images with high speed, makes the running costs less, reduces noises because of a non-impact method, and makes easier recording of the color images using multicolor inks.

As such an inkjet recording head, an electromechanical conversion type head utilizing transformation of a piezoelectric element caused by application of electrical energy can be used. On the other hand, an inkjet type recording means (recording head), in which ink is ejected by changes of state or phase such as film boiling in inks utilizing thermal energy generated at an electrothermal converter where the electrothermal converter, such as a heater for generating heat upon application of electric energy, is disposed in a liquid passage, can be easily manufactured to have a high density liquid passage layout (orifice layout) by forming electrothermal converters, electrodes, liquid passage walls, ceilings, etc. in film forms on a substrate through a semiconductor manufacturing process such as etching, evaporation, sputtering, etc. Such an inkjet type recording head can make itself further compact and is desirable for further high speed image formation. Visible images are formed on the recording medium at the recording section 101. Subsequently, the recording medium is conveyed to a flattening means by a conveyance belt 104 serving as a conveying means. The recording medium is heated and pressed with a heating roller pair 105, 106 serving as a flattening means for performing heating and pressing, thereby flattening the recording medium.

When the ink absorbing degree is compared between a case where the latex particles of 0.1 micron or less of the latex surface layer are 20% and a case where the latex particles are 10% (without pre-drying), the former permeated almost all ink solvent for about thirty seconds, but the latter permeated the ink solvent in a moment (one second or less). Thus, if the recording medium having the latter latex surface is used, time required before the recording medium enters the nip region can be shortened. In other words, the requirements for entry to the nip region are based not only on the structure but also on the recording medium. Accordingly, this embodiment refers to only a lamination method. However, the recording medium used in this invention is described below because the recording medium becomes a major factor to describe detailed advantageous points.

First, an ink reception layer exists on a base material of 175 microns. Alumina hydrate was used as the layer material and prepared in the following way. An aluminum octa-oxide was synthesized in accordance with U.S. Pat. No. 4,242,271, and was hydrolyzed to produce an alumina slurry. Water was added to the alumina slurry until the solid component of the alumina hydrate became 5%. After the slurry was heated to 80° C. and subject to maturing reactions for ten hours this colloidal sol was dried by spraying to obtain an alumina hydrate. This alumina hydrate was further mixed and dispersed with an ion exchanged water and was adjusted to have pH 10. A colloidal sol was obtained after a five hour maturing process. After being desalted, this colloidal sol was deflocculated by adding an acetic acid. When the alumina hydrate obtained through drying this colloidal sol was measured by X-ray diffraction, it turned out to be a pseudo boehmite. The colloidal sol of the alumina hydrate was condensed to produce a solution of 15% by weight. Meanwhile, a solution of 10% by weight was obtained by dissolving a polyvinyl alcohol (trade name PVA117, Kuraray Corp.) in an ion exchanged water. Those two kinds of solutions were mixed so that the ratio of the solid portion of the alumina hydrate to the solid portion of the polyvinyl alcohol was ten to one by weight, and were stirred to produce a dispersed fluid. This dispersed fluid was then coated with a dye coater on a polyethyleneterephthalate film, thereby forming a porous layer including pseudo boehmile having a thickness of 40 microns. Subsequently, a vinylchloride-vinyl acetic acid based latex (trade name, Vinybran 602, Nissin Kagaku Kogyo Co. Ltd.) having a solid portion of 15% was coated with a dye coater as a first ink reception layer (topmost layer) and dried at 70° C., thereby forming a porous latex layer (flattened layer) of about 5 microns. Thus, a recording medium having the ink reception layer and the flattened layer was obtained. Two types of the latex, a latex having 0.1 micron or less particles of 20 or more percent and a latex having such particles of ten percent, were prepared. The latex of ten percent was obtained by reducing the particles having particle size of 0.1 micron by filtering the above latex with a precision filtering film (trade name PMV313, official hole diameter 0.25 micron, Asahi Chemical Industry Co.) upon processing under a condition of replacement with a pure water amount of approximately 25 times with respect to the original fluid of the latex.

In this embodiment, an upper heating roller 105 is used as a thermal pressing means. The roller was made by finishing an addition type LTV silicon rubber, in which a resin type polyorganosiloxyane of 0.5 mm and a silica of 1% by weight as inorganic particles were mixed, to have a mirror surface on a HTV silicon rubber having a thickness of 2 mm, and the roller had a hardness of 40° under a measuring method as defined in A type of JIS K6301 standard.

The silicon rubber of the surface layer used in this embodiment was produced in the following way.

First, a mixture polysiloxyane made of a straight chain polydimethylsiloxyane of 40% by weight whose chain ends with vinyl groups, having viscosity of 10,000 PaS at 25° C., and a reinforced resin shaped organopolysiloxane of 60% by weight constituted of block polymers having in the same molecule a resin segment made of trifunctional and tetrafunctional groups and an oil segment having bifunctional groups having a viscosity of 35 PaS at 25° C., is mixed with silica powders (trade name- R-972, Nippon Aerogel Co.) made of inorganic fine particles as an aid for heat-resistance of 1% by weight to form an addition type silicon rubber component, and after the silicon rubber component is hardened for ten minutes at 150° C., it was secondarily vulcanized for four hours at 200° C. to obtain an addition type silicon rubber.

In the image forming apparatus according to the invention, when a relation to the quality of the obtained recording medium was examined upon changing the hardness of upper heating roller 105, if the hardness exceeds 70°, the surface scratches on the roller 105 are easily transferred, and occurrence of whitened images and lowering gloss degree was confirmed. In this example, as described above, while using 40° hardness for the upper heating roller, the lower heating roller 106 was made in the same structure and having the same 40° hardness. At that time, the nip width was about 5 mm; the temperature was 180° C. and adjusted by a thermistor 107 within ±5° C. Although the temperature adjustment method in this example effects turning on and off a halogen heater 120 at a prescribed temperature, it can be done in any manner as long as the prescribed temperature is attained, such as by control with electric power values. In this embodiment a cleaning member 110 and a cleaning auxiliary member (not shown) were used for the upper heating roller 105. A non-woven fabric was used for the cleaning member 110; the member 110 was cleaned by contact with a sponge roller; the cleaning member 110 was fed for about 3 mm at every prescribed number of sheets that unclean states were assumed.

The prescribed number of sheets was about 15 sheets for A4 size paper in this embodiment. Meanwhile, the cleaning auxiliary member was the cleaning member 110 to which dimethyl silicon oil having a viscosity of 10,000 cs was is soaked for about 20 g/m$^2$. The amount transferred to the recording medium at that time was 3 to 10 g/m$^2$. If this transfer amount is too much, oil may enter into scratches on the lamination material as described above, making outstanding lines and impairing its productivity.

Figure 5:
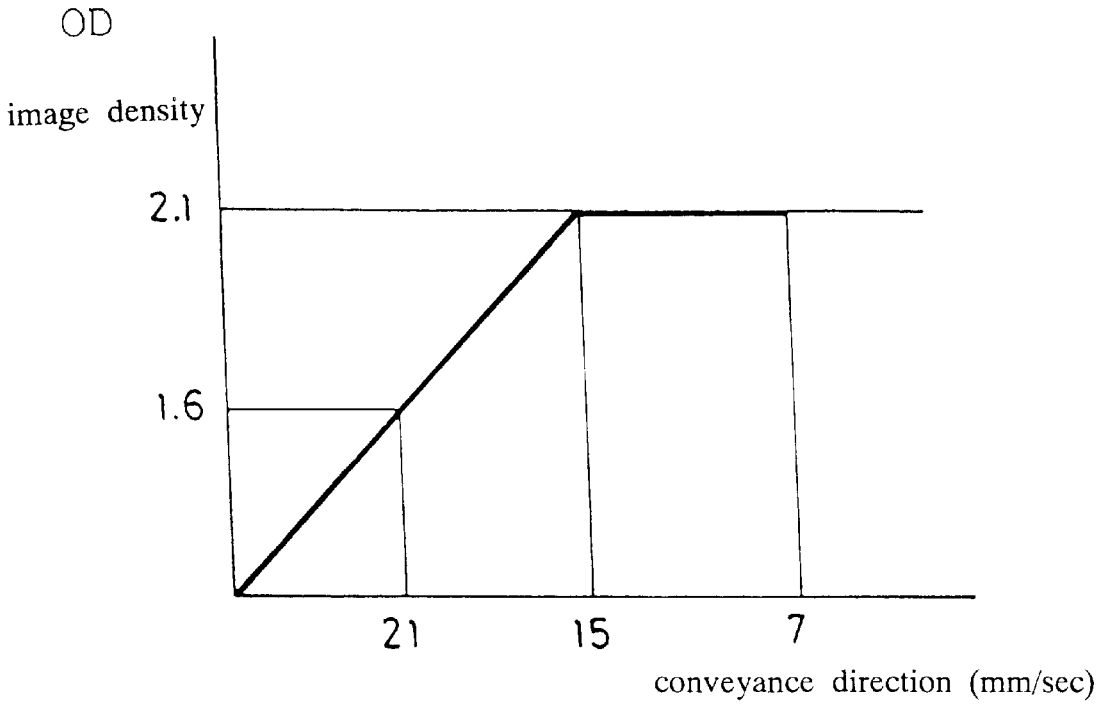
FIG. 5 is a graph showing a relation between reflected density and recording medium in this invention.

Printing was made with the above structure where the ink spraying amount was about 8 porous layer per one noise, 1200×600 dpi, with a dot diameter of 55 microns, maximum spraying amount of 250%, and spraying frequency of 10 kHz. At that time, a process BK was produced in which: BK was 100%; C, M, Y each was 50%; and the total was 250%, and relation between the conveyance speed v and the reflection density (in use of RD-918, Macbeth Co.) is shown in FIG. 5. In this graph, the ordinate indicates reflection density (OD) and the abscissa indicates the conveyance speed (mm/sec) of the recording medium before being laminated. As shown in this graph, image density is stable where the speed is at about 15 mm/sec or less, but if the speed is raised more than this, the density goes down. This is caused, as described above, by the ink solvent which remains in the topmost layer (flattened layer) or the ink reception layer at the speed of 15 mm/sec or more. Thus, high density can be reproduced even in high speed recording (high speed image forming) by absorbing the ink solvent component adequately in the ink reception layer. This effect could be seen not only in the process BK but also in other color reproduction in substantially the same manner, and the effect was remarkable, especially when the sprayed amount was relatively large. That is, by setting the conveyance speed v to 15 mm/sec or less, a time t1 is equal to or less than a time t2 where the time t1 is a period from the beginning of heating to a time when the ink solvent reaches a boiling point of the solvent and where the time t2 is a period from the beginning of heating to a time when the surface of the recording medium for forming the flattened layer reaches a melting point of the layer, and images can be settled under a good condition.

Using the image forming apparatus thus constituted, a good protection layer could be formed because the ink solvent is evaporated and dried on an upstream side of the nip region. Therefore, almost no ink was attached to the roller even though the apparatus was formed with the cleaning means and the auxiliary means.

Second Example of First Embodiment

Figure 2:
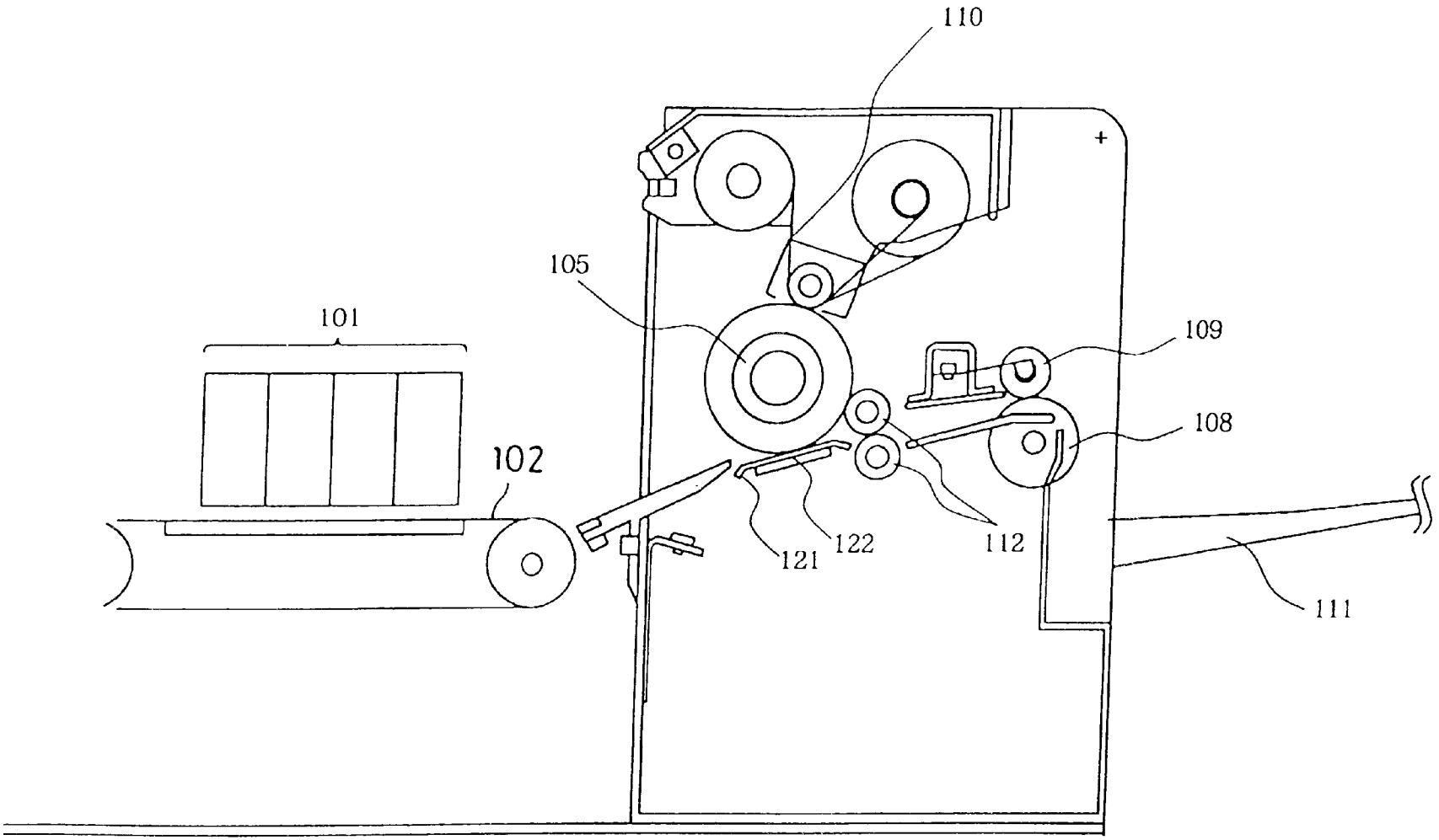
FIG. 2 is an illustration showing an image forming apparatus of a second example according to the first embodiment of the invention.

In this invention, the thermal pressing member in contact with a surface on which visible images are formed is workable as long as it operates at a speed equal to or less than a prescribed value and is also workable as long as the ink solvent component is adequately dried (or soaked into the reception layer) at a point where the thermoplastic layer (flattened layer) loses permeation nature in the nip region or the region upstream of the nip region. Accordingly, there is no particular limitation on the side of the non-recording surface of the recording medium. Therefore, as shown in FIG. 2, an iron plate or the like can be used for the non-recording surface side. In FIG. 2, a conveyance guide 121 opposing the upper heating roller 105 is a flat planar guide, and has a PTC heater 122 on the non-conveyance side. With this image forming apparatus of such a structure, a flattening process can be made by the upper heating roller 105 made of a silicon rubber as used in the above example, in substantially the same manner after images are formed. After the medium is conveyed along the conveyance guide 121, the medium is stacked on a delivery tray 111 by way of delivery rollers 108, 109. In this invention, the optimum condition can be varied depending on the spraying amount, the constitution of the ink reception layer and the topmost layer (flattened layer). However, conveyance with a speed allowing the ink solvent component to be dried before being subject to heating and pressing during the flattening process is commonly grossly effective notwithstanding the constitution or combination of those.

The condition may be different, even in an apparatus having the same structure and even for a recording medium having a similar constitution, if the thickness of the base material is different or if the material (e.g., cardboard paper instead of the PET film as in the first embodiment) is different.

By use of the above image forming apparatus, the recording medium, where the inks are dried adequately, enters into the nip region, thereby producing high quality. images.

Third Example of First Embodiment

Figure 3:
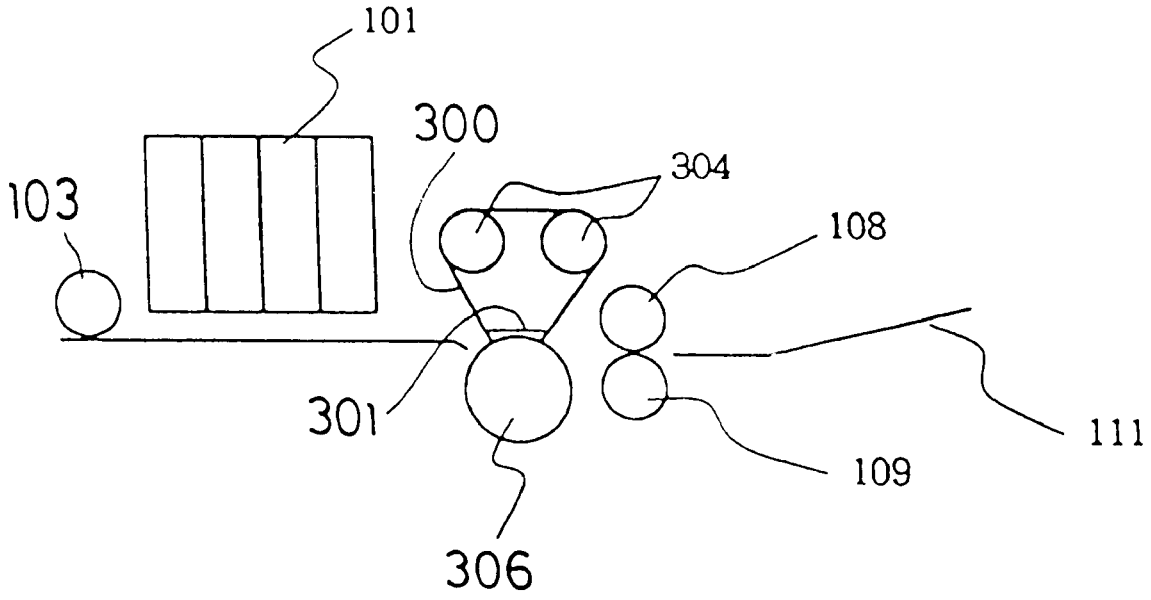
FIG. 3 is an illustration showing an image forming apparatus of a third example according to the first embodiment of the invention.
Figure 4:
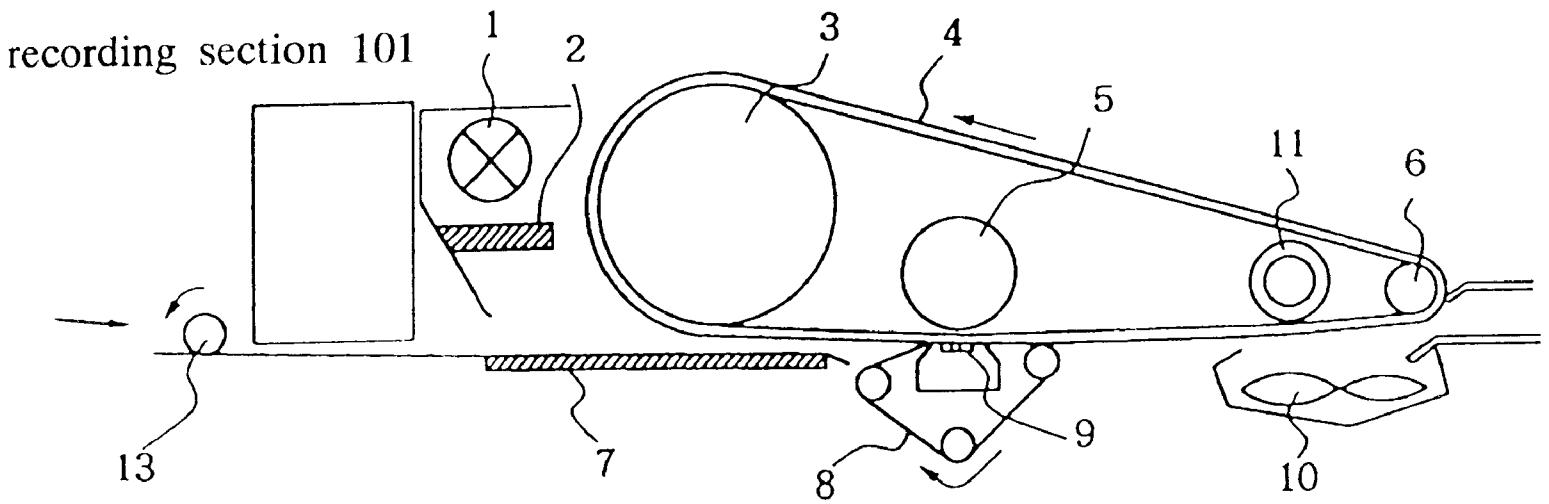
FIG.4 (Prior Art)
FIG. 4 is an illustration showing a conventional image forming apparatus.

In this Example, the thermal pressing member has an inner layer made of rubber and a porous material and can be made as a belt. Now, an image forming apparatus having substantially the same structure shown in Example 1, but using such a thermal pressing member, will be described. FIG. 3 is a cross section showing an apparatus using a heating belt 300. The recording medium having images formed by a recording head 101 is conveyed to the flattening process by a conveyance roller 103 serving as a conveying means, sandwiched by a heating belt 300, which is wound around the heating plate 301 and the tension roller 304, and a pressing roller 30, and pressed with heat. The pressing amount is determined by a spring force that the pressing roller 306 pushes up from the lower side of the apparatus and by respective elastic forces. The temperature is set by a plate heater 301, which is disposed at the opposing position to the pressing roller 306 on the surface of the heating belt 300. The heating belt 300 uses a foamed urethane sponge serving as an elastic layer and a seamless belt finished with a fluororesin coating of 20 microns serving as the topmost layer. Where the fluororesin is used for the topmost layer as in this Example, because the roller is subject to less kinematic friction, use of an opposing roller having a larger friction coefficient, e.g., made of a rubber, brings good stable conveyance. High quality images without scratches thus can be formed by using the image forming apparatus having the above structure.

Second Embodiment

A second embodiment of the present invention will be described hereinafter. A method of this embodiment is for recording images on a transfer medium, not a recording medium of the first embodiment. Moreover, a transfer process of the second embodiment corresponds to the flattening process of the first embodiment, wherein in the transfer process, a transfer layer on which ink is disposed is transferred to a material to be printed.

The transfer medium used for the second embodiment of the invention is made of at least a base material and a transfer layer, which is a porous layer consisting of material such as resin and formed on the base material. The transfer layer is transferred to a material to be printed in a condition that porous construction is lost by heat melting after thermal transfer onto the material to be printed, and if the base material has a structure that the base material can be separated, a transfer medium previously known can be used. In this second embodiment, as different from the first embodiment, the color materials of the ink are held in the transfer layer mainly, and the rest of the color materials might be held in a lower layer. That is, in the ink sprayed to the transfer layer by means of the recording head, only the ink solvent is vaporized when the transfer layer is heated and pressed during the transfer process, and the images are fixed with some color materials remaining in the transfer layer. To adequately effectuate the advantageous points of the invention, it is desirable to use a transfer medium for inkjet forming images and to use water-color inks. It is to be noted that in this embodiment, a transferring process in which the transfer layer and the material to be printed are combined in a united body corresponds to a flattening process described in the above first embodiment.

The material onto which images are to be transferred in this second embodiment is not particularly limited, but to adequately effectuate the advantageous points of the invention, it is desirable to use a paper having inferior gas permeation or ink absorbing property, and a plastic film sheet of a uniform quality or a metal sheet having a lower ink absorbing property. It is to be noted that as long as it is in a plate shape or sheet shape, the material can be any form such as molded articles, fabrics, textiles, non-woven fabrics. etc.

The inks used in this embodiment include a color material component including dyes and pigments, and a solvent component for dissolving or dispersing the color material. The solvent component is further divided to a component to be removed from the transfer medium upon evaporation and a component existing in the transfer medium and not evaporating readily. In any event, the water-color inks thus constituted are favorable for the invention. It is to be noted that the ink solvent in this embodiment is the component to be evaporated and removed from the transfer medium upon evaporation as described above.

This embodiment has a feature that the relation between the ink solvent in the transfer medium heated right before the nip region and the temperature increase of the transfer layer is as follows. That is, the boiling point of the ink solvent in the transfer medium is desirably lower than the heating temperature during the transferring process to render the solvent evaporated during the transferring processing to the material to be printed. The temperature TF during the transferring process satisfies $TF \geqq T1$ in relation to the boiling temperature T1 for contributing to evaporation and drying of the ink solvent. Similarly, where T2 denotes the melting temperature of the transfer layer mainly made of a thermoplastic resin contributing to the transfer, it is general to set $TF \geqq T2$ in estimation of temperature profile and permissive errors during the transferring process. That is, because the transfer layer material is in contact with roller or rollers during the transferring process by way of the material to be printed or support for the transfer medium, and because the porous structure of the transfer layer disappears due to melting of the resin and at the same time, clings to the material to be printed, it requires a considerable amount of heat. Consequently, temperature T3 erasing the porous property in the transfer layer satisfies $TF \equiv T3 > T2$.

It is to be noted that the relation between T1 and T2 is determined depending on the respective systems. For example, if the ink solvent is 100% water, $T1 = 100°$ C.; if the material forming the transfer layer is essentially made of a copolymer resin of a Nvlon 6 and a Nylon 12, $T2 \equiv 140°$ C.; and $T1 < T2$. If the material forming the transfer layer is essentially made of a copolymer resin of an ethylene and a vinyl acetic acid, $T2 \equiv 50°$ C., and $T1 > T2$.

Figure 8:
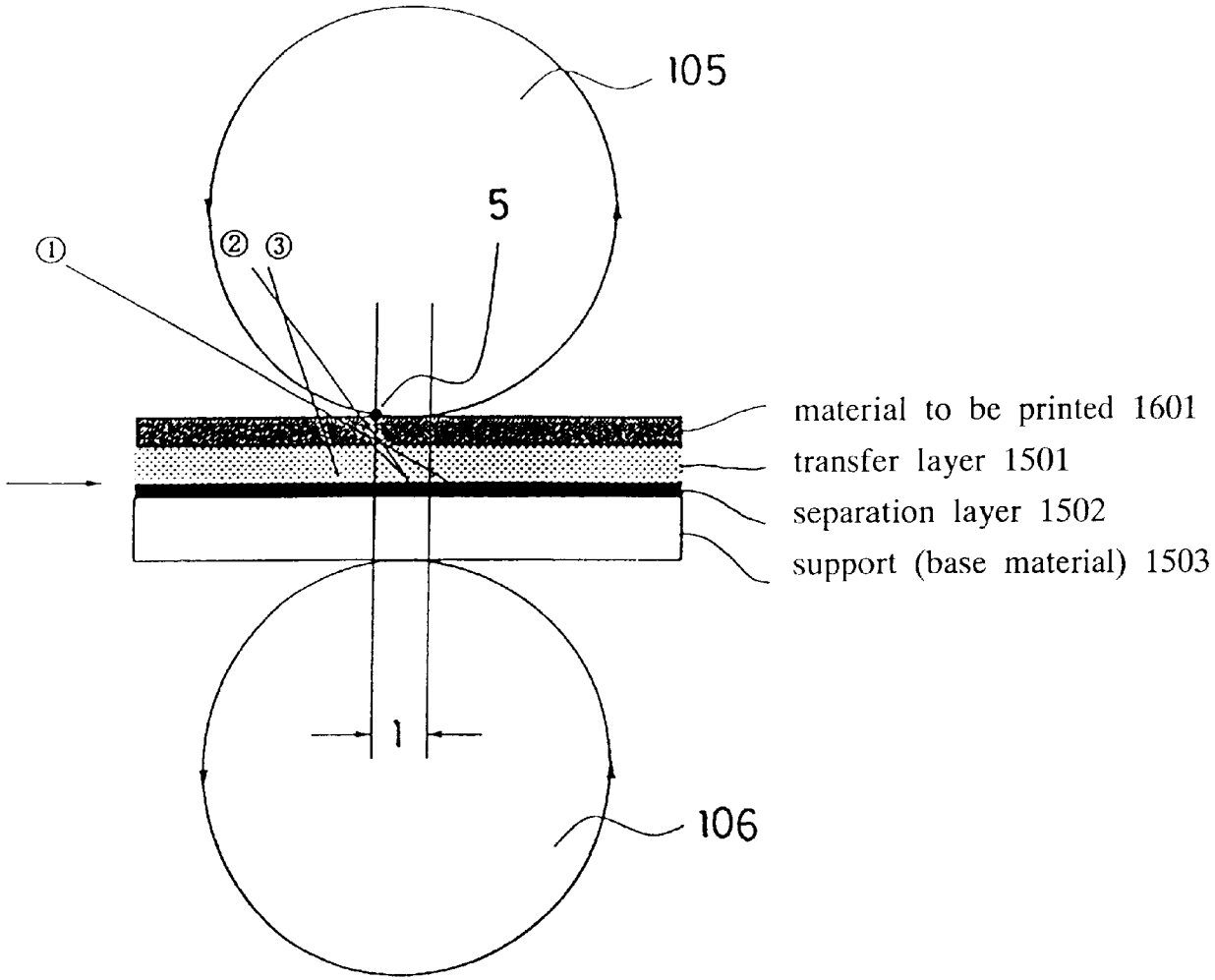
FIG. 8 is an illustration showing a flattening process in a second embodiment of the invention.

FIG. 8 indicates an outline of the transferring process for this embodiment. The transfer medium subject to the transferring process with the upper heating roller 105 is formed of a separation layer 1502 and a transfer layer 1501 on a support 1503 serving as a base material. FIG. 8 shows a state a material 1601 to be printed is overlapped on the transfer layer 1501 and subject to the transferring process at the nip region 1. The transfer layer 1501 adheres to the material 1601 to be printed upon being released from the side of the transfer medium support 1503 and the separation layer 1502 by this transferring process. The transfer layer 1501 is illustrated as laminated at the nip beginning point toward the material 1601 to be printed. The dotted lines of circled 1 to 3 indicate boundaries in the thickness direction of the recording medium between areas where the ink solvent remains as liquid and areas where the ink solvent is vaporized and removed under respective heating conditions per time unit to each of the layers different from each other. When the conveyance speed v of the transfer medium is fast, the inclination of the ink solvent amount in the transfer layer is as illustrated by a solid line of circled 1 in FIG. 8. That is, after the transfer layer is melted and adheres to the material 1601, the ink solvent evaporates. If the conveyance speed of the transfer medium is made slower than the above, changes in the thickness direction of the layer of the ink solvent amount in the transfer layer are as illustrated by a solid line of circled 2 in FIG. 8, and the inclination becomes larger. That is, differences of the ink solvent amount between the upper and lower ends in the layer thickness direction become larger. This indicates that the ink solvent starts to evaporate from the material 1601 to be printed with the transfer layer 1501 before the transfer layer completely adheres to the material to be printed (if the application amount of the ink to the transfer medium is significantly increased, this inclination becomes smaller.) If the conveyance speed v is slow, the inclination of the ink solvent amount in the transfer layer is as illustrated by a solid line of circled 3 in FIG. 8. This allows good formation of transferred images because the ink solvent begins to evaporate before reaching the nip region and because the transfer layer starts to adhere under pressure and heat to the material to be printed after the ink solvent remains in a very little amount in the transfer layer.

As a heating method in this invention, either of the upper roller 105 and the lower roller 106 can be used as a heating source because the above relation can be maintained where the roller 106, located at a lower portion in FIG. 8, is used as a heating source, and also, there would be no problem to use both rollers as heating sources.

Figure 9:
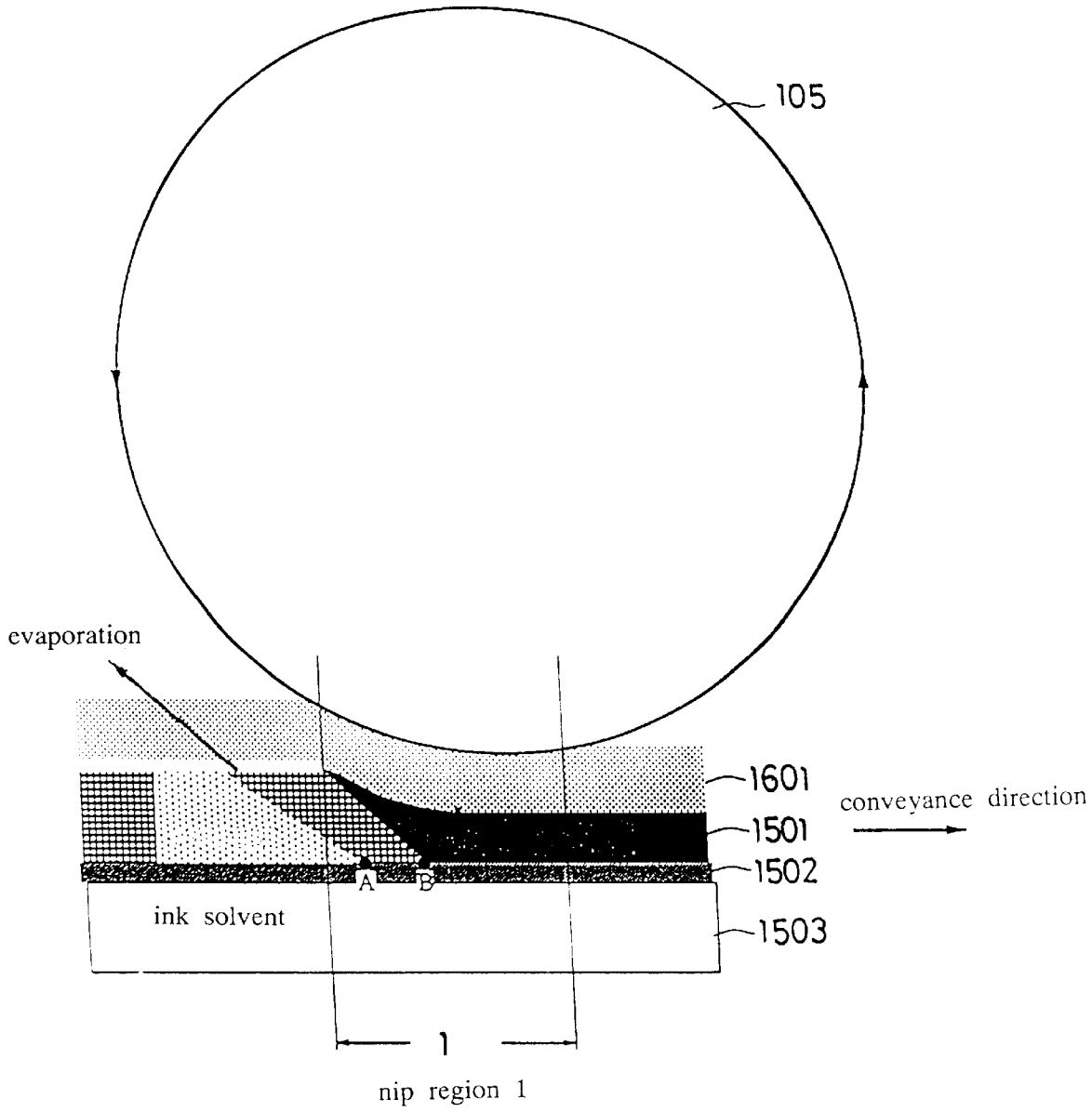
FIG. 9 is an enlarged illustration showing the flattening process in the second embodiment of the invention.

More specifically, as shown in FIG. 9, where inks may remain in the transfer medium, the transferring process of this invention can be accomplished well as long as the point A where the ink solvent reaches the boiling point is located upstream, in the conveying process, of the point B where the transfer layer is molten, adheres to the material to be printed, and loses the porous property.

In the nip region of the invention, almost all of the respective processes in which the transfer medium is thermal pressed, the transfer layer is molten, and the transfer layer adheres to the material to be printed, are executed. A thermal pressing member is disposed at the nip region, and the thermal pressing member is frequently constituted of an elastic roller pair essentially made of a rubber or the like. The invented apparatus, however, is not limited to the above structure, and any structure such as a pair structure in a belt shape or a combination of the belt and the roller, may be used as long as it includes a nip region for pressing the transfer medium and the material to be printed and as long as it is capable of heating them within the nip region.

It is to be noted that as a method for applying the inks (ink droplets) to the transfer medium, an inkjet recording method in which color images can be formed with high definition is most favorable, but the method is not limited to the inkjet recording method where high definition is not required in images to be formed or where there is another proper method to form images with high definition.

As an ink to be used for image formation, an ink applicable to the inkjet method is desirably useful. For example, such an ink may include a color material to form images and a liquid medium for dissolving and dispersing the color material as necessary components with, depending on necessity, various dispersants, surfactants, viscosity adjusting agents, specific resistance adjusting agents, pH adjusting agents, mildew proofing agents, stabilizers for dissolving and dispersing the color material, and so on. Particularly, it is desired that water ratio in the liquid medium described below is 50% or more and more preferably 70% or more. If the water ratio is less than 50%, the liquid existing in the transfer layer is increased, thereby possibly raising problems in the transferred images.

As a color material to be used in the ink, exemplified are direct dyes, acidic dyes, basic dyes, reactive dyes, food pigment, dispersed dyes, oily dyes, and various pigments, and any known materials can be used without any limitation. The contained amount of the color material in the ink is determined with respect to characteristics required for inks, and an ink having a normal density such as about 0.1 to 20% by weight can be used. As described above, where a material including a color material haying an anionic group is used as an ink, water and moisture proofing property is further improved when cationic materials in the transfer layer encounter the color materials having the anionic groups in the ink.

As a liquid medium used for dissolving and dispersing the color material, water or a mixed solvent made of water and a water-soluble organic solvent can be used. As a water-soluble organic solvent, for example, alkyl alcohol and analogs such as methanol, ethanol, isopropyl alcohol, and n-butanol, amide and analogs such as dimethylformamide, and dimethylacetaldehyde, ketone or keto alcohol and analogs such as acetone and acetone alcohol, alkylene glycol and analogs such as ethylene glycol, propylene glycol, triethylene glycol, tiodiglycol, diethylene glycol, 1,2,6-hexiane triol, and polyethylene glycol, glycerin and analogs, alkylether of polyhydric alcohol and analogs such as (di) ethyleneglycolmonomethyl (or ethyle)ether, and triethyleneglycolmono (or di) methyle (or ethyle) ether, sulfolane, n-methyl-2-pyroridone, 1,3-dimethyl-2-imidazolidinon, and one or more kinds are used. Among them, a water miscibility glycol and analogs and glycol ether and analogs having an effect to prevent the recording head from drying are used frequently. It is to be noted the ink component can be used not only for the image forming apparatus of the second embodiment, but also for the image forming apparatus of the first embodiment.

Hereinafter, a transfer medium as an important factor for describing the specific advantageous points of the invention will be described in detail.

The transfer medium used in this invention is workable as long as the transfer medium at least has a porous layer as the surface laver having a thermoplastic resin, and some known transfer mediums can be used. Particularly, the transfer medium for watercolor ink recording is favorable and useful for this invention. The following are specific examples.

As a support 1503 for the transfer medium, any support can be used as long as it is capable of forming a transfer layer at least on one side of the support, it can be conveyed without any problem in a printer or the like, and has heat resistance to thermal transfer. More specifically, exemplified are plastic films or sheets such as polyester, diacetate, triacetate, acryl based polymer, polycarbonate, polyvinylchloride, polyimide, cellophane, celluloid, or sheets made of paper, fabric, non-woven fabric, and so on. When a flexible support is used, the transfer medium can desirably match the shape of the material to be printed even where the material to be printed has more or less undulations and allows transfers to articles other than planar materials.

It is to be noted that it is preferable to provide on a surface of the support 1503 (on a surface on which the transfer layer is formed), or between the support 1503 and the transfer layer 1501, a separation agent as a separation layer 1502 made of silicon, wax, and fluoric resin to render the support to be easily peeled off after thermal transfer so that the transfer layer is transferred to the material to be printed or to effect a separation process in which the agent is contained in the support. As a separation agent, more specifically, wax and analogs such as camauba wax, paraffin wax, microcrystallin wax, caster wax, higher fatty acid and analogs and their metallic salts such as stearic acid, palmitic acid, lauric acid, aluminum stearate, lead stearate, barium stearate, zinc stearate, zinc palmitate, methylhydroxycisstearate glycerolmonohxdroxystearate, glycerohnonohydroxycisstearate, etc., derivatives such as ester, polyamide based resin, petroleum based resin, rosin derivatives, chroman-indene resin, terpene based resin, novolac based resin, styrene based resin, olefin based resin such as polyethylene, polypropylene, polybutene, acidic polyolefin, etc. and vinylether based resin. In addition to those, silicon resin, fluorosilicon resin, fluoro-olefin vinyletherterpolymer, perfluroepoxy resin, thermosetting acryl resin having a perfluoroalkyl group in side chain, Teflon resin, vinylidene fluoride based setting resin, etc. can be exemplified.

The transfer layer 1501 constituting the transfer medium is necessarily made of a material that is not encroached by inks recorded on a transfer layer of the transfer medium by the water-color ink recording apparatus, that captures many color materials (dyes and pigments in the ink) as much as possible, and that adheres to the material to be printed upon melting when transferred with heat. The transfer layer is preferably constituted of a durable material since it is located on the surface of the material to be printed after transfer. A transfer layer of a thermal transfer medium for inkjet disclosed in Japanese Unexamined Patent Publication No. 10-16,382 can be used to satisfy the above conditions.

It is preferable to contain silicon, wax, resin, etc. in the transfer layer in a range not impairing the functions of the transfer layer in order to allow good separation from the support 1502 as described above. The same materials as the separation agents described above can be used.

Any particles made of water-insoluble thermoplastic resin can be desirably used as the thermoplastic resin particles constituting the transfer layer to be used. As such thermoplastic resin particles, for example, polyethylene, polypropylene, polyethylene oxide, polyvinyl acetate, polyvinylalcohol, polyvinylacetal, poly(meta)acrylate, poly (meta)acrylate ester, polyacrylate derivative, polyacrylate amide, polyether, polyester, polycarbonate, cellulose based resin, polxacrylonitrile, polyimide, polyamide, polyvinyl chloride, polyvinylidene chloride, polystyrene, thiokol, polysulfone, polyurethane, other copolymers of those resins, and modifications are exemplified. Polyethylene, polypropylene, polyethylene oxide, poly(meta)acrylate, poly(meta)acrylate ester, polyvinyl acetate, polyvinyl chloride, polyurethane, polyamide, and copolymers of those, and modifications can be used preferably.

When the thermoplastic resin is in the form of particles, the particle size is preferably in a range of 0.05 to 100 microns, preferably, of 0.2 to 50 microns, more preferably, of 5 to 20 microns, in terms of ink absorbing property and definition of the images. If the particle size is less than 0.05 micron, spaces among particles when formed as a transfer layer are too narrow, so that the ink is not adequately absorbed, and good transfer images cannot be obtained. On the other hand, if the particle size is larger than 100 microns, the images may have lower definition, and the apparatus cannot obtain clear images.

As such particles, it is preferable to use porous particles. Use of such porous particles improves the vacancy rate in the transfer layer 1501 and increases the containing force of the transfer layer 1501 to the ink. Therefore, in comparison with use of non-porous particles, the transfer layer 1501 can be formed with a greater thickness, thereby improving the transferability and color expression ability on the material to be printed after transfer.

The binders in the transfer layer used are not limited as long as they can form the transfer layer by binding the above particles. From a viewpoint of adherence to the material 1601 to be printed and trapping ability of the color material in the transfer. layer 1501 described below, it is preferable to use water-insoluble thermoplastic resins previously known as well as in the above particles and cationically modified thermoplastic resins.

Moreover, it is preferable for the transfer layer 1501 to contain a color material trapping agent to trap the color materials (dyes and pigments) in the ink. Generally, since the color materials in inks for inkjet are frequently anionic, it is preferred to use cationic resins as color material trapping agents. As a cationic resin used in this invention, the following can be exemplified.

(1) Cationic modification of resins such as polyvinylalcohol, hydroxyethylcellulose, polyvinylpyrrolidone, and so on.

(2) Polymer and copolymer of amine based monomer such as arylamine, diarylamine, arylsulfone, dimethylarylsulfone, and diaryldimethyl ammonium chloride, and acrylmonomer having, at side chains, primary, secondary, or tertiary amine or quaternary ammonium base, such as dimethyleaminoethyl (meta) acrylate, diethylaminoethyl(meta)acrylate, methylethylaminoethyl(meta)acrylate, dimethylaminostyrene, diethylaminostyrene, methylethylaminostyrene, N-methylacrylamide, N-dimethylacrylamide, N,N-dimethylaminoethyhnetacrylamide, and their quaternary compounds.

(3) Resin having in the main chain, primary, secondary, or tertiary amine or quaternary ammonium base, such as dicyanamide.

If the color material is of pigment basis, inorganic particles are favorably used as the color material trapping agents. As an inorganic particle to be used, known pigments can be used as far as trapping the pigments in the ink and having a porous structure in liquid communication as to absorb the liquid component of the ink. It is preferable to have a fine hole diameter smaller than the pigment particles in inks. More specifically, silica, aluminum silicate, magnesium silicate, hydrotalcite, calcium carbonate, titanium oxide, clay, talc, (based) magnesium carbonate, and so on can be exemplified. If a material has a higher space rale, the transfer layer increases its ink absorbing property, in addition to this purpose, so that further clear images can be obtained.

The mixing ratio between the thermoplastic resin particles and binders is preferably in a range of 1/2 to 50/1, more preferably, 1/2 to 20/1, further preferably, 1/2 to 15/1. If an amount of the binder is more than ½, the porous property in the transfer layer is impaired, and if the ink absorbing property is low right after the inkjet recording, image resolution may be lowered. On the other hand, if the amount of the binder is less than 20/1, adherence between thermoplastic particles and between the ink absorbing layer and separation layer becomes inadequate, so that a transfer layer having adequate strength cannot be formed.

The thickness of the transfer layer 1501 is, though more favorably thinner in terms of evaporation of the ink solvent, in a range, preferably 10 microns to 150 microns in consideration of ink absorbing property, more preferably 20 microns to 120 microns, and further preferably 30 microns to 100 microns.

As a method for forming the respective layers, a method of preparing and coating a coating material by dissolving or dispersing the desirable materials in a proper solvent, a method for laminating a film on a support or layer where the film is formed, and a method of extrusion molding, can be exemplified. As a coating method, known methods such as a roller coater method, a blade coater method, an air knife method, a gate roller coater method, a bar coater method, a size press method, a sim sizer method, a spray coating method, a gravure coating method, a curtain coater method, and so on can be used.

In the support 1601, the transfer layer 1501, and the separation layer 1502, as additives other than the above materials, crosslinking agents, its catalysts, pigment dispersants, fluid improving agents, defoaming agents, bubbling agents, soaking agents, colorants, fluorescent brightening agents, ultraviolet absorbents, antioxidants, antiseptics, antifungal or anti-mold agents, plasticizers, and so on can be blended properly. Particularly, to improve transferability of the transfer layer 1501, it is desirable to blend an optimum plasticizer in the thermoplastic resin particles to be used.

As a plasticizer, previously known materials can be used. For example, ester phthalate such as diethyl phthalate, dioctyl phthalate, dimethyl phthalate, dibutyl phthalate, ester phosphate such as tributyl phosphate, triphenyl phthalate, ester adipate such as octyl adipate and isononyl adipate, ester sebacate such as dibutyl sebacate, and dioctyl sebacate, acetyltributyl citrate, acetyltriethyl citrate, dibutyl maleate, diethylhexyl maleate, dibutyl fumarate, trimellitic acid based plasticizer, polyester based plasticizer, epoxy based plasticizer, stearin based plasticizer, paraffin chloride, toluene sulfone amide and its derivative, p-oxybenzoic acid-2-ethylhexyl ester and so on can be exemplified.

As for a transfer medium, to improve ink absorbing property and preserving ability during carrying, surfactants can desirably be blended in a transfer layer 1501 and a separation layer 1502. As such surfactants, previously known materials can be used. For example, anion based carbonate, sulfonate, ester sulfate, and ester phosphate, cation based aliphatic aminate, aliphatic quaternary ammonium, benzalkonium, benzethonium chloride, pyridinium, imidazolinium, both based carboxyl betaine type, aminocarbonate, imidazoliniumbetaine, and lecithin, and non-ion based ether, etherester, ester, including nitrogen, are exemplified as surfactants.

Surfants of a fluoride or reactive type may be included. Particularly, non-ionic surfactants and fluoric surfactants can he used.

To effectuate the method and apparatus of the invention, it is desirable to use a structure actively removing the ink solvent remaining in the transfer layer of a continuous porous structure like paper or the like as a support constituting the transfer medium, and to consider the ink evaporation from not only the surface side of the transfer layer but also the back surface side or the support.

First Example, Second Embodiment

This example proposes an image forming method in which, using silicon rubber at a surface layer of the thermal pressing member, ink images held on a porous transfer layer having thermoplastic resin particles as the essential body formed on a surface layer of the transfer medium are transferred to the material to be printed by the transfer layer itself as high quality images.

Referring to the drawings, this example will be described in detail.

The following example has the same apparatus structure as in the first example of the first embodiment, and will be described here without the detail shown in FIG. 1. As shown in FIG. 1, in the same way as in the first example, the image forming apparatus for transfer has a member mounting a recording head for liquid spraying recording method (inkjet recording method) in which images are formed on the transfer medium by ejecting different colors or characteristics from orifices at a recording section 101, and the recording head is mounted on the member. The inkjet recording head effects recording by ejecting inks onto the transfer medium, and the head advantageously makes the recording means compact, allows printing high definition color images with high speed, makes the running costs less, and reduces noises. As such an inkjet recording head, a head using an electro-mechanical conversion method such as transformation of piezoelectric elements caused by application of electric energy can be used, but particularly, a recording head of an electro-thermal conversion method using a heater that generates heat upon application of electrical energy is preferable for further compact size and high speed recording.

The visible images are formed on the transfer medium in the recording section 101, and then, the medium is subject to a transferring process by pressing and heating the medium by means of the heating roller pair 105, 106 corresponding to the thermal pressing member, after the medium is overlapped with a material to be printed.

Because ink absorbing characteristics of the transfer medium during visible image formation may vary depending on the structure of the transfer medium to be used, the requirements until the medium enters in the nip region may be influenced by not only the body structure but also the transfer medium itself. However, the transfer image forming method and the apparatus for the method can effectuate the desired advantageous points under any conditions.

In this invention, as an example of the transfer medium as described above, the following transfer medium is used.

As a support, a double sided separation or peeling paper (ST600KT-T (trade name), Rintec K.K.) was used, on the surface of which, as an anchor layer, ethyleneacrylate elusion (Hitec E-8778 (trade name) Toho Kagaku Kogyo (K. K.), solid portion 25%) was formed to be about 20 g/m$^2$.

A coating material for the transfer layer (Coating material #1) was coated on the anchor layer thus formed by a jig such as Mayor bar or the like, and the material was dried in an oven set at temperature of 80° C. to form a transfer layer of about 50 g/m$^2$. The transfer medium to be used in the invention was thus obtained.

Coating material #1

(1) Thermoplastic particles: Nylon resin porous particles (Olgasole 3501EXDNAT (trade name), Elf At Chem K.K., average particle diameter 12 microns), 100 parts by weight.
(2) Binder: ethylene-acrylate emulsion (Hitec E-8778 (trade name), Toho Kagaka Kogyo (K. K.), solid portion 25%) 360 parts by weight.
(3) Binder: urethane emulsion (Takelac W-635C (trade name), Takeda Industries (K. K.), solid portion 35%) 30 parts by weight.
(4) Inorganic particles: silica (Mizukacile P-78A (trade name), Mizusawa Kagaku Kogyo (K. K.), average diameter 3 microns) 4 parts by weight.
(5) Cation resin: acryl based cation resin solution (EL polymer NWS-16 (trade name), Shinnakamura Kagaku Kogyo KK., solid portion 35%) 30 parts by weight
(6) Surfactants: fluoric surfactant solutions (Surflone S-131 (trade name), Seimi Chemical K.K., solid portion 30%) 8 parts by weight.
(7) Plasticizers: N-ethyl-o, p-toluene sulfoneamide (Topsizer 3 (trade name) Fuji Amide Chemical K. K.) 20 parts by weight.
(8) Isopropyl alcohol 300 parts by weight.

Meanwhile in this example, an upper heating roller 105 was used as the thermal pressing member. The roller was made by finishing an addition type LTV silicon rubber of 0.5 mm (its detail is described below), in which a resin type polyorganosiloxyane and inorganic particles (silica) were mixed, to have a mirror surface on HTV silicon rubber having a thickness of 2 mm. The roller had a measured hardness of 40° as defined in A type of JIS K6301 standard. The above addition type LTV silicon rubber thus used is described here in detail. First, a mixture polysiloxyane made of a straight chain polydimethylsiloxyane of 40% by weight whose chain ends with vinyl groups, having a viscosity of 10,000 PaS at 25° C., and a reinforced resin shaped organopolysiloxane of 60% by weight constituted of block polymers having in the same molecule resin segments made of trifunctional and tetrafinctional groups and an oil segment having bifunctional groups having a viscosity of 35 PaS at 25° C., was mixed with silica (trade name: R-972, Nippon Aerogel Co.) made of inorganic fine particles of 1% by weight to form an addition type silicon rubber component, and after the addition type silicon rubber component was hardened for ten minutes at 150° C., it was secondarily vulcanized to obtain an addition type silicon rubber.

In the image forming apparatus according to this example, the above structure was used for the upper heating roller 105, as well as for the lower heating roller 106. At that time, the nip width was about 5 mm; the surface temperature was 180° C. The surface temperature was adjusted by a thermistor 107 within ±5° C. with respect to the prescribed temperature. This temperature adjustment method, which was a method of turning on and off a halogen heater 120 at a prescribed temperature, can be done in any manner as long as the prescribed temperature is controlled, such as control with electric power values. In this embodiment, a cleaning member 110 for the upper heating roller 105 and a cleaning auxiliary member (not shown) were used. A non-woven fabric was used for the cleaning member; the member was cleaned by contact with a sponge roller; the member was fed by about 3 mm at every prescribed number of sheets that unclean states were assumed.

The prescribed number of sheets was about 15 sheets for A4 size paper in this embodiment. Meanwhile, the cleaning auxiliary member was the cleaning member 110 to which dimethyl silicon oil having a viscosity of 10,000 cs was soaked for about 20 g/m$^2$.

Recording to the transfer medium was made using the inkjet recording head where the ink ejection amount was about 8 porous layer per one noise, 1200×600 dpi, with a dot diameter of 55 microns, ink recording density of 250%, and spraying frequency of 10 kHz. Here the ink recording density of 250% means a process black color of a recording density of 250% in total where a black ink is of recording density of 100% (recording in which black ink is ejected to each pixel) and where a cyan ink, a magenta ink. and a yellow ink are of recording density of 50%, respectively. At that time, the transfer medium was conveyed while changing the conveyance speed v, thereby forming a recording patten of a square of about 20 mm×about 20 mm. The relation between the conveyance speed v of the transfer medium (mm/sec) and shape retention of the recorded pattern of the transferred material was examined. As a result, when the conveyance speed of the transfer medium was larger than 0 mm/sec but equal to or smaller than 15 mm/sec, the shape retention of the recorded pattern of the transferred material was stable and maintained the square as recorded (see. FIG. 5 in the first embodiment). When the conveyance speed of the transfer medium exceeded 15 mm/sec but was equal to or smaller than 20 mm/sec, the shape could be recognized but the square was not maintained; the shape retention of the recorded pattern was impaired. When the conveyance speed of the transfer medium exceeded 20 mm/sec, the shape of the recorded pattern could not be recognized. This is because the ink solvent component in the transfer medium could not evaporate entirely and remained where the conveyance speed of the transfer medium exceeded 15 mm/sec. That is, by setting the conveyance speed of the transfer medium at 15 mm/sec or less, a time t1 is equal to or less than a time t2, where the time t1 is a period from the beginning of heating to a time when the ink solvent reaches a boiling point of the solvent and where the time t2 is a period from the beginning of heating to a time when the surface of the transfer medium reaches a melting point of the layer, and images can be settled under a good condition.

That is, by use of the transfer image forming apparatus thus constituted, the ink solvent is evaporated and dried on the upstream side of the nip region, so that good transfer could be implemented.

Second Example of Second Embodiment

In this invention, the transfer medium on which visible images are formed is operative as long as it is conveyed with speed of a prescribed value or less before the medium comes in direct or indirect contact with the thermal pressing member, and is also workable as long as the ink solvent component is dried before the transfer layer essentially made of thermoplastic particles loses permeation property, within the nip region or the upstream region of the nip region. Accordingly, there is no particular limitation on the mounting position and shape of the heating source. Therefore, similarly to the second example of the first embodiment, an iron plate or the like can be used for the other side of the transfer layer (support side). In utilizing FIG. 1 showing the second example of the first embodiment, a conveyance guide 121 opposing the upper heating roller 105 is a flat planar guide, and has a PTC heater 122 on the non-conveyance side. With such a transfer image forming apparatus, as well as in the first embodiment, the upper heating roller 105 made of a silicon rubber makes transfer after images are formed. Subsequently, the medium is moved to the delivery tray 111 by conveyance drive by the delivery rollers 108, 109.

Even in the invention in which substantially the same conveyance condition as in the first embodiment is not applicable, the ink solvent is evaporated and dried on the upstream side of the nip region, so that good transfer could be implemented. It is to be noted that the transfer condition may vary depending on cases where, e.g., the support or resin for the thermoplastic resin constituting the transfer medium may be different from the above.

However, even in such a case, there would be change in that good transfer could be implemented because the ink solvent is evaporated and dried on the upstream side of the nip region.

Third Embodiment

Figure 10:
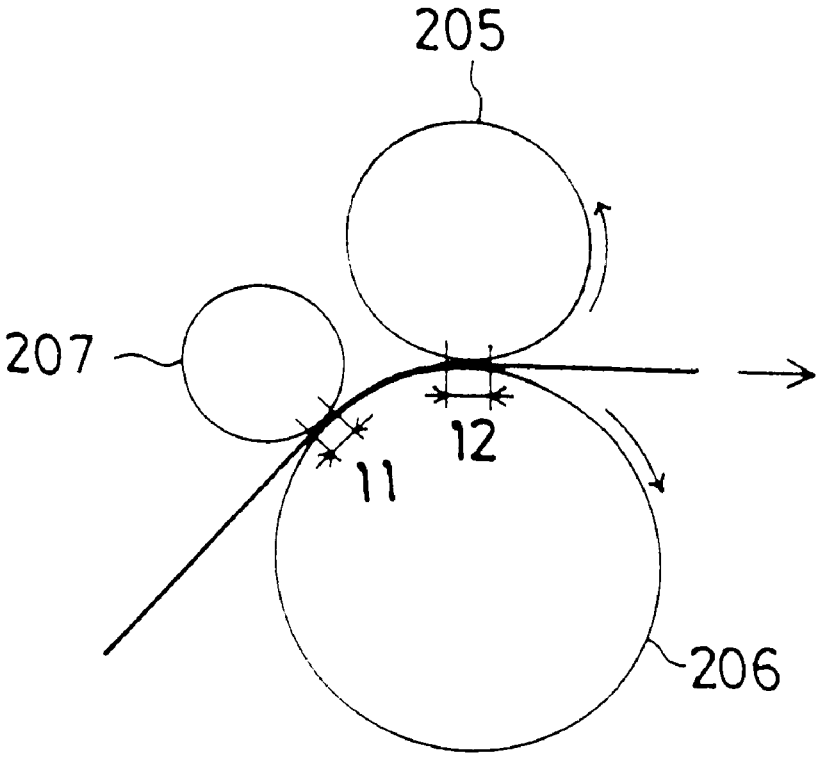
FIG. 10 is an illustration showing a flattening process in a third embodiment of the invention.

Referring to FIG. 10, a third embodiment of the invention is described. FIG. 10 is an illustration of a flattening means in the image forming apparatus of the third embodiment. In this embodiment, a plurality of nip regions is formed where plural upper heating rollers are disposed as to oppose a lower heating roller.

As shown in FIG. 10, a recording medium on which images are formed by an inkjet recording head (not shown) is conveyed by a conveying apparatus (not shown) to a flattening means constituted of an upper main heating roller 205, an upper preheating roller 207, and a lower heating roller 206.

The recording medium conveyed by this apparatus receives in advance heat from the upper preheating roller 207 disposed on an upstream side of the upper main heating roller 205 at a first nip region 11. Right after this, the recording medium is conveyed to a second nip region constituted of the upper main heating roller 205 and the lower heating roller 206, and is subject to heating and pressing for the flattening process as described above.

According to this embodiment, because plural upper heaters are provided, the temperatures of individual rollers can be reduced. Therefore, this structure can minimize unfavorable thermal influence such as drying which affects the recording head. Since the heating rollers can have reduced temperatures, this structure also can shorten waiting time to operation start.

Since the recording medium is preheated by the upper preheating roller 207, the temperature transfer from the upper main heater roller 205 is smaller, thereby suppressing temperature change of the roller 205, and thereby allowing temperature control with high precision. The recording medium is heated at a broader area in which the first and second nip regions are added, so that heating deviations of the recording medium can be reduced.

By arrangement of the plural heating rollers, the pressure amount of each roller can be reduced. Therefore, the heating rollers whose surfaces are formed of the soft material as described above can be subject to lesser loads. Moreover, the distance between the point A and the point B can be changed by giving a curve to the temperature or pressure applied between the image portion and the non-image portion where the pressure amounts are changed between the upper preheating roller 207 and the upper main heating roller 205. Therefore, the ink can be settled effectively by changing surface conditions of the heating means constituted of the upper preheating roller 207 and the upper main heating roller 205, and such surface conditions can be controlled after this heating process.

In addition, the two upper heating rollers 205, 207 press the recording medium toward the round surface of the lower heating roller 206, so that curls that may occur in association with evaporation of the ink solvent may be corrected.

Fourth Embodiment

Figure 11:
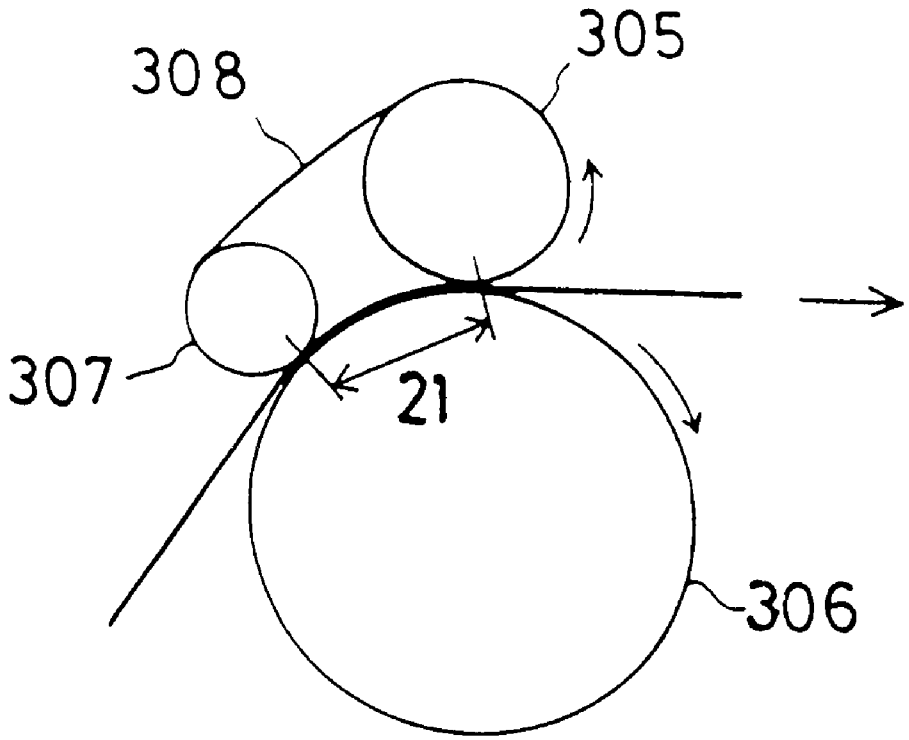
FIG. 11 is an illustration showing a flattening process in a fourth embodiment of the invention.

Referring to FIG. 11, a fourth embodiment of the invention is described. FIG. 11 is an illustration showing a flattening means in the image forming apparatus according to this embodiment. In this embodiment, a heating belt is wound around the plural heating rollers to ensure a wider nip region.

As shown in FIG. 1, the flattening means of this embodiment has the heating belt 308 wound around an upper first heating roller 305 and a second heating roller 307, and the heating belt 308 is constituted 50 as to be in contact with the lower heating roller 306 in the prescribed area. A nip region 21 is defined as the contact area between the heating belt 308 and the lower heating roller 306.

In this embodiment, the nip region is wider than the nip region in the third embodiment, so that the advantageous points in the third embodiment can be obtained surely.

It is to be noted that the third and fourth embodiments are applicable to a structure using a transfer layer as an ink reception layer as in the second embodiment, as a matter of course.

What is claimed is:

1. An image forming method comprising the steps of:

forming visible images by application of an ink, which at least includes an ink solvent and a color material, onto a recording medium comprising a porous layer having a liquid permeating property, the ink being applied on a surface of the medium from a side of the porous layer;

conveying the recording medium in a conveying direction from a location for forming images to a location for a subsequent process; and heating the recording medium while pressing the recording medium at a nip region to eliminate the liquid permeating property of the porous layer, wherein, in the nip region that the surface of the recording medium formed with the visible images is pressed, a point A at which the ink solvent contained in the recording medium reaches the boiling point is located upstream, relative to the conveying direction, of a point B at which the liquid permeating property of the porous layer is eliminated.

2. The image forming method according to claim 1, wherein a conveyance speed v of the recording medium during the step of conveying the recording medium is so set that a time t1 is equal to or less than a time t2, where the time t1 is a period from the beginning of heating to a time when the ink solvent reaches a boiling point of the solvent during the heating step and where the time t2 is a period from the beginning of heating to a time when the temperature of the porous layer reaches a melting point of the layer.

3. The image forming method according to claim 1 or claim 2, wherein the images are formed by an ink jet recording head for discharging ink from an orifice.

4. The image forming method according to claim 3, wherein the recording head discharges the ink from the orifice using thermal energy generated by an electrothermal converter.

5. An image forming method comprising the steps of:

forming visible images by application of an ink, which at least includes an ink solvent and a color material, onto a recording medium comprising a porous layer having a liquid permeating property, the ink being applied on a surface of the medium from a side of the porous layer;

conveying the recording medium in a conveying direction from a location for forming images to a location for a subsequent process; and heating the recording medium while pressing the recording medium at a nip region to eliminate the liquid permeating property of the porous layer, wherein the recording medium further comprises an ink reception layer and the porous layer includes thermoplastic resin particles and is formed on the ink reception layer, and wherein, in the nip region that the surface of the recording medium formed with the visible images is pressed, a point A at which the ink solvent contained in the recording medium reaches the boiling point is located upstream, relative to the conveying direction, of a point B at which the liquid permeating property of the porous layer is eliminated.

6. The image forming method according to claim 5, wherein a conveyance speed v of the recording medium during the step of conveying the recording medium is so set that a time t1 is equal to or less than a time t2, where the time t1 is a period from the beginning of heating to a time when the ink solvent reaches a boiling point of the solvent during the heating step and where the time t2 is a period from the beginning of heating to a time when the temperature of the porous layer reaches a melting point of the layer.

7. The image forming method according to claim 5 or claim 6, wherein the recording medium is pressed while heating by means of a roller pair during the step for heating the surface.

8. The image forming method according to claim 5 or claim 6, wherein the recording medium is conveyed faster at the step of forming images than at the step of heating the recording medium, and wherein the conveyance speed changes at a timing before a front end of the recording medium is conveyed to the nip region of the recording medium.

9. The image forming method according to claim 5 or claim 6, wherein during the step of heating the recording medium, the recording medium is sandwiched between one or more upper heating rollers and one or more lower heating rollers corresponding to the respective one or more upper heating rollers to press the recording medium while heating.

10. The image forming method according to claim 9, wherein the one or more upper heating rollers comprise a preheating roller and a main heating roller positioned at a downstream side of the preheating roller in the conveying direction of the recording medium.

11. The image forming method according to claim 10, wherein a pressing belt is wound around the upper heating rollers.

12. The image forming method according to claim 5 or claim 6, wherein the images are formed by an ink jet recording head for discharging ink from an orifice.

13. The image forming method according to claim 12, wherein the recording head discharges the ink from the orifice using thermal energy generated by an electrothermal converter.

14. An image forming method comprising the steps of:

forming visible images by application of an ink, which at least includes an ink solvent and a color material, onto a recording medium comprising a porous layer having a liquid permeating property, the ink being applied on a surface of the medium from a side of the porous layer;

conveying the recording medium overlapped with a material to be printed on the recording medium in a conveying direction from a location for forming images to a location for a subsequent process; and heating the recording medium and the material to be printed while pressing the recording medium at a nip region to eliminate the liquid permeating property of the porous layer, wherein the recording medium at least includes a base material, a separation layer formed on the base material, and a transfer layer made of the porous layer including thermoplastic resin particles formed on the separation layer, and wherein, in the nip region that the surface of the recording medium formed with the visible images is pressed, a point A at which the ink solvent contained in the recording medium reaches the boiling point is located upstream, relative to the conveying direction, of a point B at which the liquid permeating property of the porous layer is eliminated.

15. The image forming method according to claim 14, wherein a conveyance speed v of the recording medium during the step of conveying the recording medium is so set that a time t1 is equal to or less than a time t2, where the time t1 is a period from the beginning of heating to a time when the ink solvent reaches a boiling point of the solvent and where the time t2 is a period from the beginning of heating to a time when the temperature of the porous layer reaches a melting point of the layer.

16. The image forming method according to claim 14 or claim 15, wherein the recording medium is pressed while heating by means of a roller pair.

17. The image forming method according to claim 14 or claim 15, wherein the recording medium is conveyed faster at the step of forming images than at the step of heating the recording medium, and wherein the conveyance speed changes at a timing before a front end of the recording medium is conveyed to the nip region of the recording medium.

18. The image forming method according to claim 14 or claim 15, wherein during the step of heating the recording medium, the recording medium is sandwiched between one or more upper heating rollers and one or more lower heating rollers corresponding to the respective one or more upper heating rollers to press the recording medium while heating.

19. The image forming method according to claim 18, wherein the one or more upper heating rollers comprise a preheating roller and a main heating roller positioned at a downstream side of the preheating roller in the conveying direction of the recording medium.

20. The image forming method according to claim 19, wherein a pressing belt is wound around the upper heating rollers.

21. The image forming method according to claim 14 or claim 15, wherein the images are formed by an ink jet recording head for discharging ink from an orifice.

22. The image forming method according to claim 21, wherein the recording head discharges the ink from the orifice using thermal energy generated by an electrothermal converter.

23. An image forming apparatus comprising:

forming means for forming visible images by application of an ink, which at least includes an ink solvent and a color material, onto a recording medium comprising a porous layer having a liquid permeating property, the ink being applied on a surface of the medium from a side of the porous layer;

conveying means for conveying the recording medium in a conveying direction from a location for forming images to a location for a subsequent process; and a heating member to heat the recording medium while pressing the recording medium at a nip region to eliminate the liquid permeating property of the porous layer, wherein, in the nip region that the surface of the recording medium formed with the visible images is pressed, a point A at which the ink solvent contained in the recording medium reaches the boiling point is located upstream, relative to the conveying direction, of a point B at which the liquid permeating property of the porous layer is eliminated.

24. The image forming apparatus according to claim 23, wherein a conveyance speed v of the recording medium during conveyance of the recording medium is so set that a time t1 is equal to or less than a time t2, where the time t1 is a period from the beginning of heating to a time when the ink solvent reaches a boiling point of the solvent while the recording medium is heated and where the time t2 is a period from the beginning of heating to a time when the temperature of the porous layer reaches a melting point of the layer.

25. The image forming method according to claim 23 or claim 24, wherein the images are formed by an ink jet recording head for discharging ink from an orifice.

26. The image forming method according to claim 25, wherein the recording head discharges the ink from the orifice using thermal energy generated by an electrothermal converter.

27. An image forming method comprising the steps of:

forming visible images by application of an ink, which at least includes an ink solvent and a color material, onto a recording medium comprising a porous layer having a liquid permeating property, the ink being applied on a surface of the medium from a side of the porous layer;

conveying the recording medium at conveyance speeds from a location for forming images to a location for a subsequent process; and heating the recording medium while pressing the recording medium at a nip region to eliminate the liquid permeating property of the porous layer, wherein the recording medium further comprises an ink reception layer and the porous layer includes thermoplastic resin particles and is formed on the ink reception layer, wherein, in the nip region that the surface of the recording medium formed with the visible images is pressed, a point A at which the ink solvent contained in the recording medium reaches the boiling point is located upstream, relative to the conveying direction, of a point B at which the liquid permeating property of the porous layer is eliminated, and wherein the conveyance speed at a time that the recording medium is heated and pressed is slower than the conveyance speed at a time that the visible images are formed on the recording medium.

28. The image forming method according to claim 27, wherein the visible images are formed by an ink jet recording head for discharging ink from an orifice.

29. The image forming method according to claim 28, wherein the recording head discharges ink from the orifice using thermal energy generated by an electrothermal converter.

30. An image forming method comprising the steps of:

forming visible images by application of an ink, which at least includes an ink solvent and a color material, onto a recording medium comprising a porous layer having a liquid permeating property, the ink being applied on a surface of the medium from a side of the porous layer;

conveying the recording medium overlapped with a material to be printed on the recording medium at conveyance speeds from a location for forming images to a location for a subsequent process; and heating the recording medium and the material to be printed while pressing the recording medium at a nip region to eliminate the liquid permeating property of the porous layer, wherein the recording medium at least includes a base material, a separation layer formed on the base material, and a transfer layer made of the porous layer including thermoplastic resin particles formed on the separation layer, wherein, in the nip region that the surface of the recording medium formed with the visible images is pressed, a point A at which the ink solvent contained in the recording medium reaches the boiling point is located upstream, relative to the conveying direction, of a point B at which the liquid permeating property of the porous layer is eliminated, and wherein the conveyance speed at a time that the recording medium is heated and pressed is slower than the conveyance speed at a time that the visible images are formed on the recording medium.

31. The image forming method according to claim 30, wherein the images are formed by an ink jet recording head for discharging ink from an orifice.

32. The image forming method according to claim 31, wherein the recording head discharges ink from the orifice using thermal energy generated by an electrothermal converter.

33. An image forming method for forming an image and covering with porous layer having a liquid permeating property as thermoplastic resin on recording medium on which the image is formed with an ink, which at least include an ink solvent and a color material, said method comprising the step of:

heating the recording medium while pressing the recording medium at a nip region to eliminate the liquid permeating property of the porous layer, wherein, in the nip region that the surface of the recording medium formed with visible images is pressed, a point A at which the ink solvent contained in the recording medium reaches the boiling point is located upstream, relative to a conveying direction, of a point B at which the liquid permeating property of the porous layer is eliminated.

34. The image forming method according to claim 33, wherein a conveyance speed v of the recording medium during a step of conveying the medium is so set that a time t1 is equal to or less than a time t2, where the time t1 is a period from the beginning of heating to a time when the ink solvent reaches a boiling point of the solvent during the heating step and where the time t2 is a period from the beginning of heating to a time when the temperature of the porous layer reaches a melting point of the layer.

35. The image forming method according to claim 34, wherein the image is formed by an ink jet recording head for discharging ink from an orifice.

36. The image forming method according to claim 35, wherein the recording head discharges ink from the orifice using thermal energy generated by an electrothermal converter.

37. An image forming apparatus for forming an image and covering with porous layer having a liquid permeating property as thermoplastic resin on recording medium on which the image is formed with an ink, which at least includes an ink solvent and a color material, said apparatus comprising:

a heating member to heat the recording medium while pressing the recording medium at a nip region to eliminate the liquid permeating property of the porous layer, wherein, in the nip region that the surface of the recording medium formed with visible images is pressed, a point A at which the ink solvent contained in the recording medium reaches the boiling point is located upstream, relative to the conveying direction, of a point B at which the liquid permeating property of the porous layer is eliminated.

38. The image forming apparatus according to claim 37, wherein a conveyance speed v of the recording medium during conveyance of the recording medium is so set that a time t1 is equal to or less than a time t2, where the time t1 is a period from the beginning of heating to a time when the ink solvent reaches a boiling point of the solvent while the recording medium is heated and where the time t2 is a period from the beginning of heating to a time when the temperature of the porous layer reaches a melting point of the layer.

39. The image forming apparatus according to claim 38, wherein the image is formed by an ink jet recording head for discharging ink from an orifice.

40. The image forming apparatus according to claim 39, wherein the recording head discharges ink from the orifice using thermal energy generated by an electrothermal converter.

* * * * *

UNITED STATES PATENT AND TRADEMARK OFFICE

CERTIFICATE OF CORRECTION

PATENT NO. : 6,332,679 B1
DATED : December 25, 2001
INVENTOR(S) : Higuma et al.

It is certified that error appears in the above-identified patent and that said Letters Patent is hereby corrected as shown below:

Title page,
Item [56], References Cited: FOREIGN PATENT DOCUMENTS, "1-85768 3/1999" should read -- 1-85768 3/1989 --.
Item [75], ABSTRACT:
Line 10, "that" should read -- where --.

Drawings:
Sheet 6, Figure 6, "flatting" should read -- flattening --.

Column 1,
Line 21, "with" should be deleted.

Column 4,
Line 2, "Aquafic" should read -- Aquatic --.

Column 9,
Line 14, "is" should be deleted.

Column 12,
Line 9, "Nvlon" should read -- Nylon --.

Column 13,
Line 57, "tiodiglycol," should read -- thiodiglycol, --.
Line 60, "ethyle)" should read -- ethylene) --.
Line 61, "methyle (or ethyle)" should read -- methylene (or ethylene) --.
Line 62, "pyroridone," should read -- pyrrolidone, --.

Column 14,
Line 40, "glycerohnonohydroxycisstearate," should read
-- glycerolmonohydroxycisstearate, --.

Column 15,
Line 9, "polyxacrylonitrile," should read -- polyacrylonitrile, --.
Line 63, "dimethylaminoethyhnetacrylamide," should read
-- dimethylaminoethylmetacrylamide, --.

Column 16,
Line 11, "rale," should read -- rate, --.

UNITED STATES PATENT AND TRADEMARK OFFICE

CERTIFICATE OF CORRECTION

PATENT NO. : 6,332,679 B1
DATED : December 25, 2001
INVENTOR(S) : Higuma et al.

It is certified that error appears in the above-identified patent and that said Letters Patent is hereby corrected as shown below:

Column 18,
Line 10, "Mayor" should read -- Meyer --.

Column 21,
Line 54, "that" should read -- where --.

Column 22,
Line 27, "that" should read -- where --.

Column 23,
Line 28, "that" should read -- where --.

Column 24,
Line 21, "that" should read -- where --.
Line 61, "that" should read -- where --.

Column 25,
Line 32, "that" should read -- where --.

Column 26,
Line 1, "that" should read -- where --.
Line 34, "that" should read -- where --.

Signed and Sealed this

Second Day of July, 2002

*Attest:*

*Attesting Officer*

JAMES E. ROGAN
*Director of the United States Patent and Trademark Office*